US008574030B2

(12) United States Patent
Wilson et al.

(10) Patent No.: US 8,574,030 B2
(45) Date of Patent: Nov. 5, 2013

(54) METHOD OF MAKING AN ICE SKATE BLADE

(75) Inventors: Murray David Wilson, Harrow (CA); Steven David Wilson, Harrow (CA); Omer Leon Hageniers, Windsor (CA)

(73) Assignee: 1339513 Ontario Ltd., Ontario (CA)

( * ) Notice: Subject to any disclaimer, the term of this patent is extended or adjusted under 35 U.S.C. 154(b) by 0 days.

(21) Appl. No.: 13/600,348

(22) Filed: Aug. 31, 2012

(65) Prior Publication Data

US 2013/0001901 A1 Jan. 3, 2013

Related U.S. Application Data

(63) Continuation of application No. 13/073,497, filed on Mar. 28, 2011, now Pat. No. 8,277,284, which is a continuation-in-part of application No. 12/402,838, filed on Mar. 12, 2009, now Pat. No. 8,056,907, which is a continuation-in-part of application No. 12/114,191, filed on May 2, 2008, now Pat. No. 7,934,978.

(60) Provisional application No. 60/928,322, filed on May 10, 2007.

(51) Int. Cl.
*B24B 1/00* (2006.01)

(52) U.S. Cl.
USPC ..... 451/45; 76/83; 451/56

(58) Field of Classification Search
USPC ..... 76/83; 451/45, 56, 65, 72, 231, 278, 451/293, 383, 443
See application file for complete search history.

(56) References Cited

U.S. PATENT DOCUMENTS

| | | | |
|---|---|---|---|
| 60,431 | A | 12/1866 | Scott et al. |
| 83,339 | A | 10/1868 | Thurston |
| 750,696 | A | 1/1904 | Price |
| 1,100,976 | A | 6/1914 | Hille |
| 1,181,831 | A | 5/1916 | Browne |

(Continued)

FOREIGN PATENT DOCUMENTS

| | | | |
|---|---|---|---|
| CA | 1179696 | A1 | 12/1984 |
| CA | 2173001 | A1 | 2/1997 |
| CA | 2373449 | A1 | 11/2000 |
| WO | WO-0067949 | A1 | 11/2000 |

OTHER PUBLICATIONS

CA Office Action dated Dec. 13, 2011 for Canadian Application No. 2,630,749, filed May 6, 2008, entitled "Ice Skate Blade Sharpening Machine" to Hageniers et al., 3 pages.

(Continued)

*Primary Examiner* — Timothy V Eley
(74) *Attorney, Agent, or Firm* — Remarck Law Group PLC

(57) ABSTRACT

A sharpening machine generally includes a grinding wheel having a perimeter that is rotatable about a first axis. The sharpening machine includes an adjustment device adapted to be coupled to a structure of the sharpening machine. A shaft, mounted to the adjustment device, defines a second axis that is generally parallel to the first axis when the adjustment device is coupled to the structure and is movable along a predetermined feed axis toward the grinding wheel. A carousel is rotatably connected to the shaft of the adjustment device. A contouring tool having a counter surface is rotatably connected to the carousel. Movement of the shaft of the adjustment device along the feed axis is configured to translate the carousel and move the contouring tool into and out of engagement with the grinding wheel to facilitate dressing of the perimeter of the grinding wheel to a grinding wheel contour.

20 Claims, 23 Drawing Sheets

(56) References Cited

U.S. PATENT DOCUMENTS

| | | | |
|---|---|---|---|
| 1,786,553 | A | 12/1930 | Thorngren |
| 2,055,665 | A | 9/1936 | Moon |
| 2,181,923 | A | 12/1939 | Smolarek |
| 2,229,374 | A | 1/1941 | Devau |
| 2,486,850 | A | 11/1949 | Ives |
| 2,904,342 | A | 9/1959 | Jones et al. |
| 3,271,906 | A | 9/1966 | Esopi |
| 3,517,659 | A | 6/1970 | Kane et al. |
| 3,735,533 | A | 5/1973 | Salberg |
| 3,827,185 | A | 8/1974 | Smith |
| 4,055,026 | A | 10/1977 | Zwicker |
| 4,094,101 | A | 6/1978 | Robinson |
| 4,114,913 | A | 9/1978 | Newell et al. |
| 4,235,050 | A | 11/1980 | Hannaford et al. |
| 4,271,635 | A | 6/1981 | Szalay |
| 4,294,043 | A | 10/1981 | Sakcriska |
| D264,984 | S | 6/1982 | Olivieri |
| 4,392,658 | A | 7/1983 | Redmond et al. |
| 4,411,250 | A | 10/1983 | Lach |
| 4,534,134 | A | 8/1985 | Consay et al. |
| 4,535,571 | A | 8/1985 | Smith |
| 4,615,144 | A | 10/1986 | Peacock et al. |
| 4,722,152 | A | 2/1988 | Ek et al. |
| 4,756,125 | A | 7/1988 | Kadnar |
| 4,805,586 | A | 2/1989 | Borse |
| 4,907,813 | A | 3/1990 | Hall |
| 5,009,039 | A | 4/1991 | Lager et al. |
| 5,287,657 | A | 2/1994 | Tschida et al. |
| 5,354,078 | A | 10/1994 | BelleIsle |
| 5,431,597 | A | 7/1995 | Anderson |
| 5,445,050 | A | 8/1995 | Owens |
| 5,499,556 | A | 3/1996 | Exner et al. |
| 5,547,416 | A | 8/1996 | Timms |
| D373,399 | S | 9/1996 | Both |
| 5,570,893 | A | 11/1996 | Swande |
| 5,591,069 | A | 1/1997 | Wurthman |
| 5,704,829 | A | 1/1998 | Long |
| 5,725,419 | A | 3/1998 | Osthoff et al. |
| 5,826,890 | A | 10/1998 | Swande |
| 6,030,283 | A | 2/2000 | Anderson |
| 6,113,474 | A | 9/2000 | Shih et al. |
| 6,116,989 | A | 9/2000 | Balastik |
| 6,203,028 | B1 | 3/2001 | Kress |
| 6,286,498 | B1 | 9/2001 | Sung |
| 6,308,700 | B1 | 10/2001 | Lierse |
| 6,368,198 | B1 | 4/2002 | Sung et al. |
| 6,422,934 | B1 | 7/2002 | Blach et al. |
| 6,443,819 | B2 | 9/2002 | Sakcriska |
| 6,467,778 | B1 | 10/2002 | Goldsmith et al. |
| 6,481,113 | B1 | 11/2002 | Brenner et al. |
| 6,619,674 | B2 | 9/2003 | Baldwin |
| 6,695,322 | B2 | 2/2004 | Goldsmith et al. |
| D500,112 | S | 12/2004 | Brumpton |
| 6,830,251 | B2 | 12/2004 | Titzmann |
| 6,953,390 | B2 | 10/2005 | Sakurai et al. |
| D514,643 | S | 2/2006 | Henderson |
| 7,073,810 | B2 | 7/2006 | Wilson |
| 7,234,709 | B2 | 6/2007 | Lambert |
| D555,180 | S | 11/2007 | Amamoto et al. |
| 7,387,302 | B2 | 6/2008 | Goldsmith et al. |
| 7,559,828 | B2 | 7/2009 | Liao |
| D603,432 | S | 11/2009 | Wilson et al. |
| 7,648,146 | B2 | 1/2010 | Tatomir |
| D626,978 | S | 11/2010 | Huh |
| D637,676 | S | 5/2011 | Wilson et al. |
| 7,934,978 | B2 | 5/2011 | Wilson et al. |
| 2002/0014041 | A1 | 2/2002 | Baldoni et al. |
| 2003/0106270 | A1 | 6/2003 | Baldoni et al. |
| 2004/0157537 | A1 | 8/2004 | Tatum et al. |
| 2005/0276979 | A1 | 12/2005 | Slutz et al. |
| 2006/0040584 | A1 | 2/2006 | Ray et al. |
| 2006/0183411 | A1 | 8/2006 | Moon |
| 2007/0001426 | A1 | 1/2007 | Wade |
| 2008/0051013 | A1 | 2/2008 | Burgess |
| 2009/0273149 | A1 | 11/2009 | Wilson et al. |

OTHER PUBLICATIONS

CA Office Action dated Jun. 13, 2011 for Canadian Application No. 2,663,095, filed Apr. 16, 2009, entitled "Ice Skate Blades" to Wilson et al., 2 pages.

CA Office Action dated Jun. 8, 2011 for Canadian Application No. 2,630,749, filed May 6, 2008, entitled "Ice Skate Blade Sharpening Machine" to Hageniers et al., 3 pages.

Office Action dated Feb. 15, 2012 for U.S. Appl. No. 13/073,497, entitled "Ice Skate Blades and Sharpening Machines" to Wilson et al., 19 pages.

Office Action dated Mar. 25, 2011 for U.S. Appl. No. 12/402,838, filed Mar. 12, 2009, entitled "Ice Skate Blades" to Wilson et al., 15 pages.

Office Action dated Nov. 26, 2010 for U.S. Appl. No. 12/402,838, filed Mar. 12, 2009, entitled "Ice Skate Blades" to Wilson et al., 20 pages.

Office Action dated Nov. 9, 2010 for U.S. Appl. No. 12/114,191, filed May 2, 2008, entitled "Ice Skate Blade Sharpening Machine" to Wilson et al., 9 pages.

Office Action dated Oct. 6, 2010 for U.S. Appl. No. 12/114,191, filed May 2, 2008, entitled "Ice Skate Blade Sharpening Machine" to Wilson et al., 20 pages.

Printout purporting to be a portion of Abrasive Technology, Manufacturer of Diamond & CBN Tooling: Resin & Metal Bonded Product Line and including a copyright notice date of 2004 on the final page, 11 pages.

Printout purporting to be a portion of Norton Stock Catalog 2005-2006 Diamond Tools and bearing no date, 16 pages.

Printout purporting to be a webpage of Norton Abrasives from 2006 and bearing a date of Jul. 29, 2011, 1 page.

Submission of Prior Art Under Provisions of Section 34 for Canadian Application No. 2,630,749 dated Jul. 29, 2011, 141 pages.

METHOD OF MAKING AN ICE SKATE BLADE

CROSS-REFERENCE TO RELATED APPLICATIONS

This application is a continuation of U.S. patent application Ser. No. 13/073,497 titled Ice Skate Blade Sharpening Machines And Associated Method Of Dressing A Grinding Wheel and filed on 28 Mar. 2011, which is a continuation-in-part of U.S. patent application Ser. No. 12/402,838 titled Ice Skates Blades and filed on 12 Mar. 2009, now issued as U.S. Pat. No. 8,056,907, which is a continuation-in-part of U.S. patent application Ser. No. 12/114,191 titled Ice Skate Blade Sharpening Machine and filed on 2 May 2008, now issued as U.S. Pat. No. 7,934,978, which claims priority benefit of U.S. Provisional Patent Application No. 60/928,322 filed on 10 May 2007. This application is related to U.S. Design patent application Ser. No. 29/317,605 titled Ice Skate Holder and filed on 2 May 2008, now issued as U.S. Design Pat. No. D603,432; U.S. Design patent application Ser. No. 29/333,603 titled Flat Bottom Vee Ice Skate Blade and filed on 12 Mar. 2009, now issued as U.S. Design Pat. No. D637,676; and U.S. Design patent application Ser. No. 29/388321 titled Flat Bottom Vee Ice Skate Blade and filed on 28 Mar. 2011. The entire disclosures of each of the above applications are incorporated herein by reference.

FIELD

The present invention relates to improvements in ice skate blades and the sharpening machines for ice skate blades.

BACKGROUND

This section provides background information related to the present disclosure which is not necessarily prior art.

In winter sports such as ice skating and hockey, the blades of an ice skate are the point of contact for all of the forces generated in turns, spins, jumps, etc. Known ice skate blade profiles typically have a convex shape along a length of the skate blade known as a rocker radius (often along with a second portion near each edge having a second radius or entry radius). Known ice skate blade profiles also have a concave (circular) profile across the bottom of the blade, and this profile defines two edges along the length of the blade. A skater can use either of these two edges in executing maneuvers on the ice surface.

Skate blades for different uses differ from one pair to another. There are always competing requirements for different applications. The operator of a skate sharpening machine that makes a blade profile is required to first dress the grinding wheel to have the desired contour and then ensure that during the grinding process a centerline of the profile on the wheel coincides with a centerline of the blade along its full length. If this is not done, then an irregular groove will be created along the length of the blade, with one edge being higher/lower than the other.

The dressing of the skate sharpening grinding wheel is traditionally carried out using a single point diamond dresser that is swung in a circular arc across the surface of the spinning grinding wheel about an axis perpendicular to the axis of rotation of the grinding wheel to give the wheel a convex surface with a radius of between ¼ inch and two inches. This technique creates the circular arc profile on the grinding wheel for grinding a complimentary concave profile across the width of the skate blade.

Limiting the blade profile to a circular, concave shape restricts a range between the maximum depth of the concave, circular profile, h, and the included angle, θ measured between the vertical side edge and a line formed generally tracking the concave profile near a bottom of the side edge. These two variables, h and θ, are interconnected by the following equation for the edges even condition:

Where:

r—is the radius of the circular arc in the bottom of the skate blade, w—is the width of the skate blade, h—is the maximum depth of the circular arc, θ—is the edge angle between the vertical side edge of the skate blade and a tangent line formed tracking the circular arc at the bottom of the side edge.

$$h=r(1-\cos\{a\sin[w/2r]\}) \quad (1)$$

$$\theta=90°-a\sin(w/2r) \quad (2)$$

For a hockey skate blade, typically w=0.110 inches. Given this limitation on the width, and that the known profiles have a radius, a table can be developed with a list of corresponding r, h and θ values as set forth below.

| radius, r (in) | depth, h (in) | edge angle, θ (degrees) |
|---|---|---|
| 0.250 | 0.00613 | 77.29 |
| 0.500 | 0.00303 | 83.68 |
| 0.750 | 0.00202 | 85.79 |
| 1.000 | 0.00151 | 86.85 |
| 1.250 | 0.00121 | 87.48 |
| 1.750 | 0.00101 | 87.90 |
| 2.000 | 0.00076 | 88.42 |

Smaller radii provide better turning ability along with slower glide speeds, while larger radii provide superior glide speeds along with poorer turning ability. However, with a circular blade profile, the range of edge angles, θ, and depths, h, is very limited. It would be desirable to provide an ice skate blade with profiles having greater variation.

Some alternative ice skate blade profiles are known. For example, Canadian Patent Publication 2,173,001 to Danese discloses an ice skate blade with multiple irregular angled edges along the bottom of the blade. Such an ice skate blade profile is impractical in that it will be very slow and provide poor turning ability. Canadian Patent Publication 1,179,696 to Redmond et al. discloses various ice skate blade profiles many of which impractically have a center portion of the bottom extending below the side edges. Below is understood here to refer to the direction towards the ice when a skater is wearing a skate with an ice skate blade. Such ice skate blade profiles can be very unstable and can provide questionable lateral control.

SUMMARY

The present teachings generally include a sharpening machine including a grinding wheel having a perimeter that is rotatable about a first axis. The sharpening machine generally includes an adjustment device adapted to be coupled to a structure of the sharpening machine. A shaft is mounted to the adjustment device. The shaft defines a second axis that is generally parallel to the first axis when the adjustment device is coupled to the structure. The shaft is movable along a predetermined feed axis toward the grinding wheel. A carousel is rotatably connected to the shaft of the adjustment device. A contouring tool is rotatably connected to the carousel. The contouring tool has a contour surface. Movement of the shaft of the adjustment device along the feed axis is configured to translate the carousel and move the contouring tool into and out of engagement with the grinding wheel to facilitate dressing of the perimeter of the grinding wheel to a grinding wheel contour.

Further areas of applicability will become apparent from the description provided herein. The description and specific examples in this summary are intended for purposes of illustration only and are not intended to limit the scope of the present teachings.

DRAWINGS

The drawings described herein are for illustrative purposes only of selected aspects of the present teachings and not all possible implementations, and are not intended to limit the scope of the present disclosure.

Corresponding reference numerals indicate corresponding parts throughout the several views of the drawings.

DETAILED DESCRIPTION

Example aspects of the present teachings will now be described more fully with reference to the accompanying drawings.

It will be apparent to those skilled in the art, that is, to those who have knowledge or experience in this area of technology that many uses and design variations are possible for the improved ice skate blade sharpening machine and profiles disclosed herein. The following detailed discussion of various aspects of the present teachings will illustrate the general principles with reference to the ice skate blade sharpening machine and groove profiles particularly suited for skaters in hockey, figure skating, and speed skating. Other aspects of the present teachings that can be suitable for other applications will be readily apparent to those skilled in the art given the benefit of this disclosure.

Figure 1:
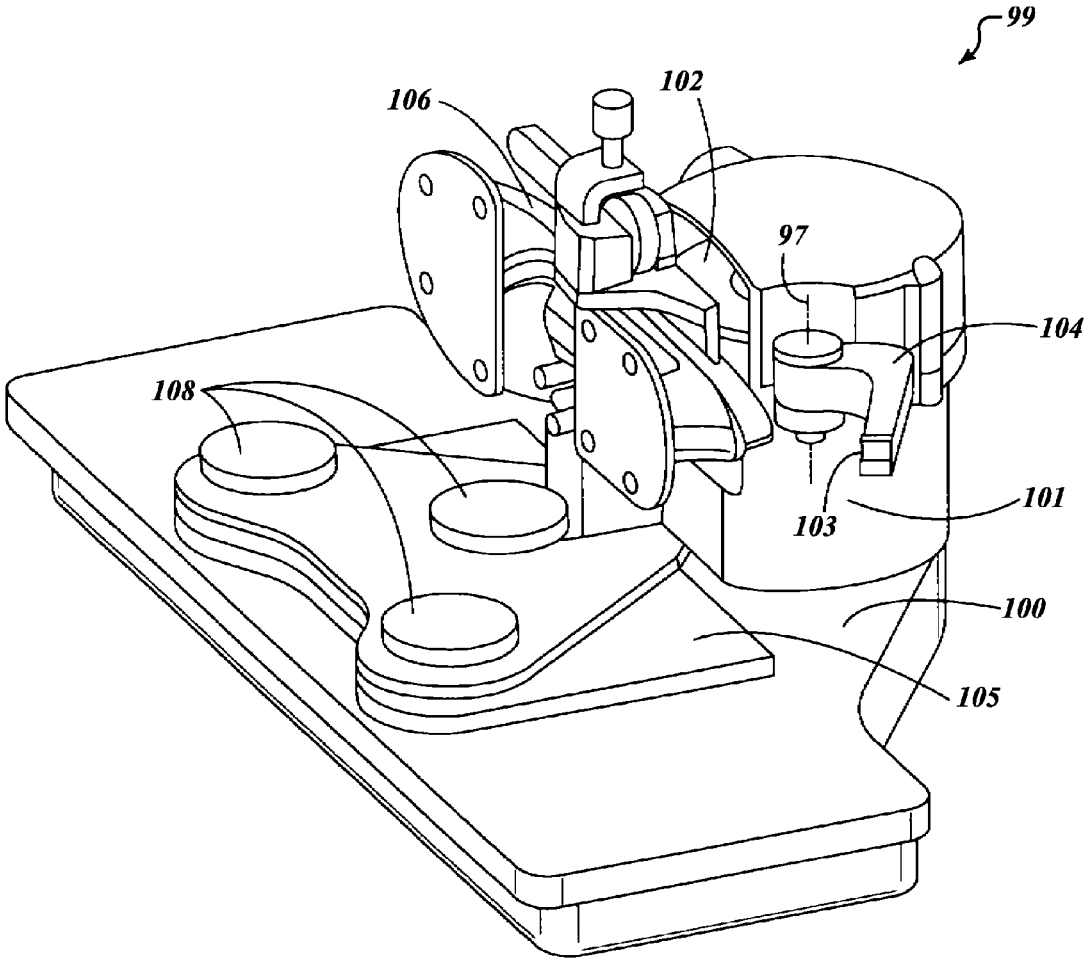
FIG. 1 is an isometric view of an ice skate blade sharpening machine in accordance with an aspect of the present teachings.

Turning now to the drawings, FIG. 1 shows an ice skate blade sharpening machine 99 in accordance with a preferred embodiment. The blade sharpening machine 99 comprises a working surface 100, a motor in a vertical housing 101, a grinding wheel 102 rotated by the motor, a contouring tool 103, a pivot arm mechanism 104, and a skate blade holder 105. Also shown is a skate blade 106 to be sharpened.

Figure 2:
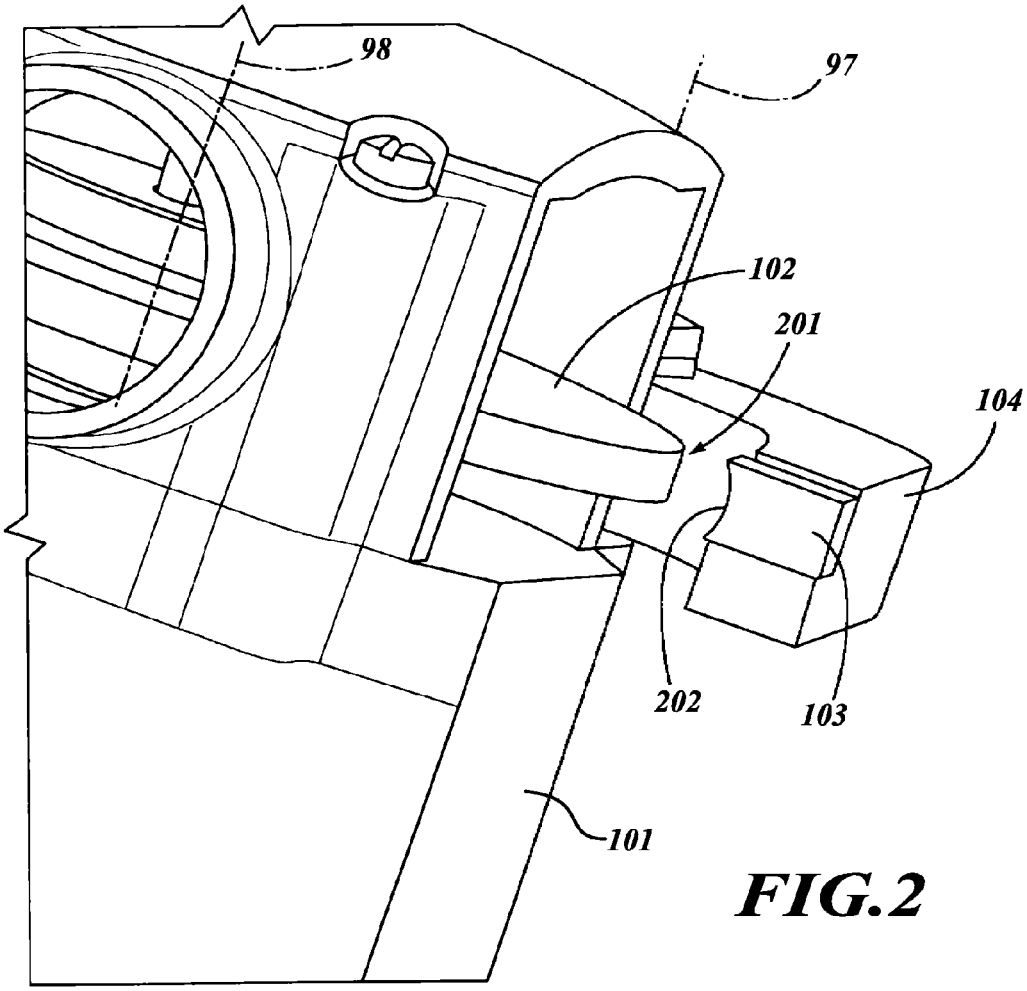
FIG. 2 is a partial isometric view of a fixed contouring tool positioned to be in close proximity to a grinding wheel during a dressing operation in accordance with the present teachings.

FIG. 2 shows the grinding wheel 102 having a periphery 201 which is as of yet unground into a desired profile. Forming such a profile is a two step process. First, the contouring tool 103 dresses and shapes the grinding wheel 102 to define a grinding wheel contour 303 (shown in FIG. 3) by use of grinding the periphery 201 of the grinding wheel 102 against a contour surface 202. Typically this occurs by rotating the grinding wheel about a grinding wheel axis 98 while the contour surface engages the grinding wheel. Second, rotation of the grinding wheel 102 about axis 98 allows the grinding wheel contour 303 to engage and grind the ice skate blade 106 to form an ice skate blade profile 107. The ice skate blade profile 107 is typically the same shape as the contour surface 202, and opposite or a mirror image of the grinding wheel contour 303. Thus, if the contour surface is convex, the grinding wheel contour is concave and the blade profile is convex.

In sharpening the blade of a skate, it is important that a centerline 116 of the ice skate blade 106 be aligned with a centerline 112 of the contour 303 of the grinding wheel 102 as the blade is moved by movement of the skate blade holder 105 during the blade sharpening process. See FIG. 3. Adjustment and proper alignment of the ice skate blade 106 with respect to the grinding wheel 102 is accomplished in part by three adjusting screws 108 located on the skate blade holder 105 (shown in FIG. 1).

The contouring tool is mounted on an adjustment device, here a pivot arm mechanism 104, which is movable about a pivot arm axis 97 between an engaged position where the contour surface 202 engages the grinding wheel and a disengaged position where the contour surface 202 does not engage the grinding wheel. As shown here, the pivot arm axis 97 is generally parallel to the grinding wheel axis 98. The pivot arm mechanism 104 allows for easy removal of one contouring tool and replacement with another. Other adjustment devices for moving the contour surface into and out of engagement with the grinding wheel 102 are discussed below.

Figure 5:
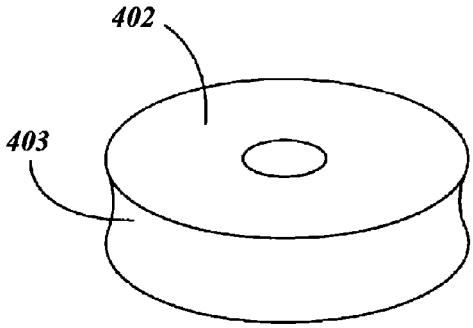
Figure 6:
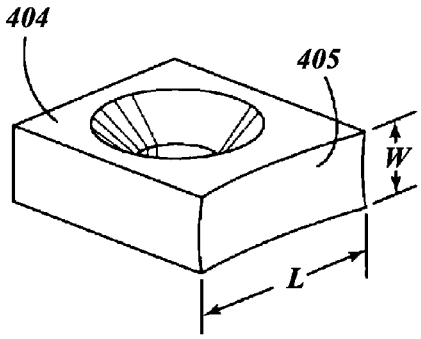
Figure 7:
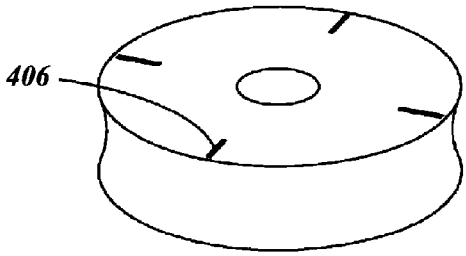

In accordance with a highly advantageous feature, the contour surface described herein may have any of a variety of cross-sections instead of being limited to the convex arcuate profile of known blade sharpening devices. This makes it possible for skaters to experiment and find a given profile that gives them better performance in skating than currently used profiles. FIGS. 5-7 show several examples of contouring tools, each with a different contour surface. Bar style contouring tool 400 has a contour surface 401 formed as a pair of generally linear surfaces. Alternatively, a disc style contouring tool may be used. Disc style contouring tools can be advantageous in that they can be turned, thereby exposing a fresh surface area of the disc to the grinding wheel 102 and providing for a longer life of the tool. Disc style contouring tool 402 is provided with a concave contour surface, or, as in contour surface 403 the shape of contour surface may be constantly changing.

For example, the convex arcuate cross-section may be a variable radius such as, for example, from ⅜" to 1" extending continuously around the disc. Bar style contouring tool 404 may be formed with a double concave contour surface 405, with curved surfaces along both the width W and length L of the contour surface. Each of these surfaces may be thought of as concave in the broad sense that the edges (such as edges 411 and 412) cut deeper into the grinding wheel 102 than does the middle (such as middle 413) of the contour surface 401. The second radius on the double concave contour surface can provide better conformity between the fixed contouring tool and the grinding wheel 102 and can provide longer fixed contouring tool life because of a larger contact area. Preferably the width w of the contour surface is at least equal to the width 422 of the grinding wheel contour 303, allowing for complete contact of the grinding wheel contour without moving the contour tool with respect to the grinding wheel axis of rotation.

Figure 3:
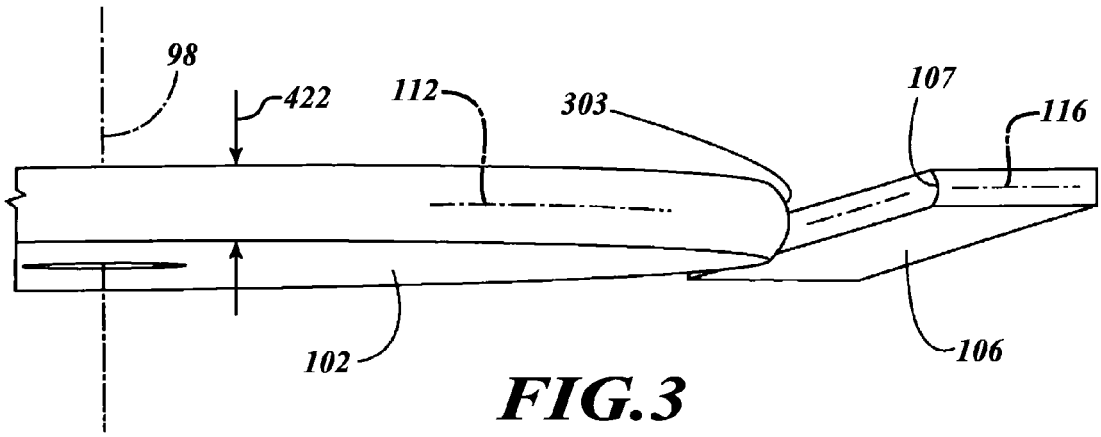
FIG. 3 is a side view of a skate blade in close proximity to the grinding wheel during the skate sharpening process in accordance with the present teachings.
Figure 4:
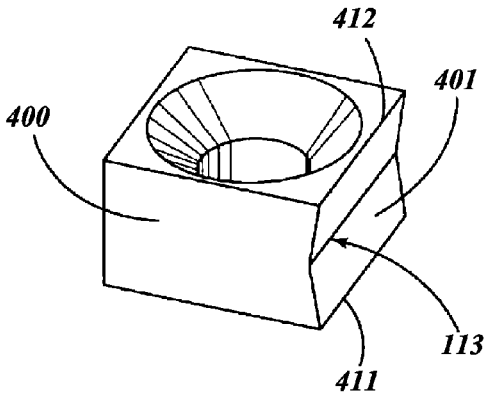
FIGS. 4-7 are diagrams of exemplary styles of fixed contouring tools for use in dressing grinding wheels in accordance with the present teachings.

With reference to FIGS. 2 and 3, the contouring tool 103 may advantageously be manufactured to various dimensions and geometries to cover a spectrum of profiles normally used by skate sharpeners. For example, when the desired profile 107 on the blade 106 is concave and has a radius, the profile dimensions may be of: 1/4, 3/8, 1/2, 5/8, 3/4, 7/8, 1, 11/8, 11/4, 13/8, 11/2, and 15/8 (inches). Other combinations of contouring tool shapes and contour surfaces, such as parabolic and elliptical shapes, or non-concave shapes such as flat bottomed or multi-groove, will be readily apparent to those skilled in the art given the benefit of this disclosure.

Advantageously, the contouring tools disclosed herein can be readily interchangeable and allow for rapid switching from one radius to another as sharpening goes from one set of skates to another. Changing a contouring tool can be done much quicker than the time required to redress a grinding wheel to a different radius using the traditional single point diamond dresser.

Figure 8:
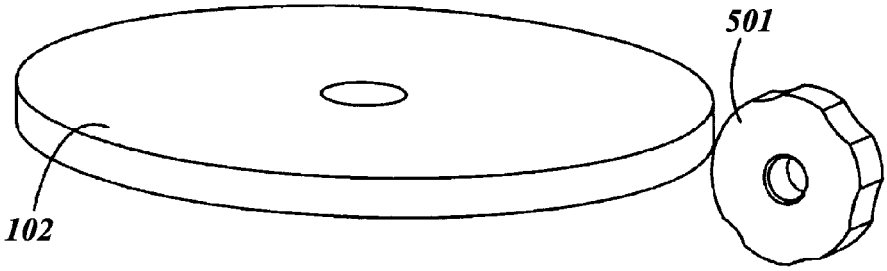
FIG. 8 is a diagram of an indexable disc fixed contouring tool in close proximity to the grinding wheel in accordance with the present teachings.

In accordance with another highly advantageous feature, a contouring tool may be indexable as shown in the preferred embodiment of FIG. 8. Contouring tool 501 comprises an indexable disc that has several different contours around its edge. Marks or indicators 406 may be provided to indicate to a user what contour surface options are available. Preferably while disengaged from the grinding wheel 102, the contouring tool 501 can be rotated or indexed to one of several different positions, with each position having a separate contour surface. As shown, the contouring tool 501 is perpendicular to the grinding wheel axis. Preferably the contouring tool would be held in position with respect to the grinding wheel axis while in the engaged position.

Contouring tools disclosed herein are preferably coated with an abrasive material that is harder than material which forms the grinding wheel 102. In turn, the grinding wheel material is preferably harder than the material that forms the ice skate blades 106. A preferred abrasive coating suitable for use on the contouring tool herein is diamond dust, chips, or grit in a plated metallic surface coating such as electroplated nickel.

Figure 9:
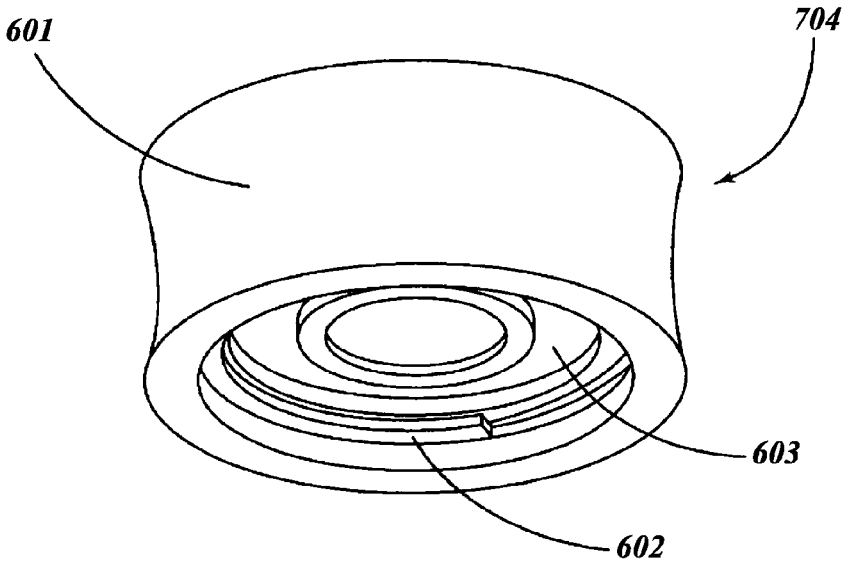
FIG. 9 is a diagram of a rotating contouring tool showing a contour surface and a ball bearing assembly in accordance with the present teachings.
Figure 10:
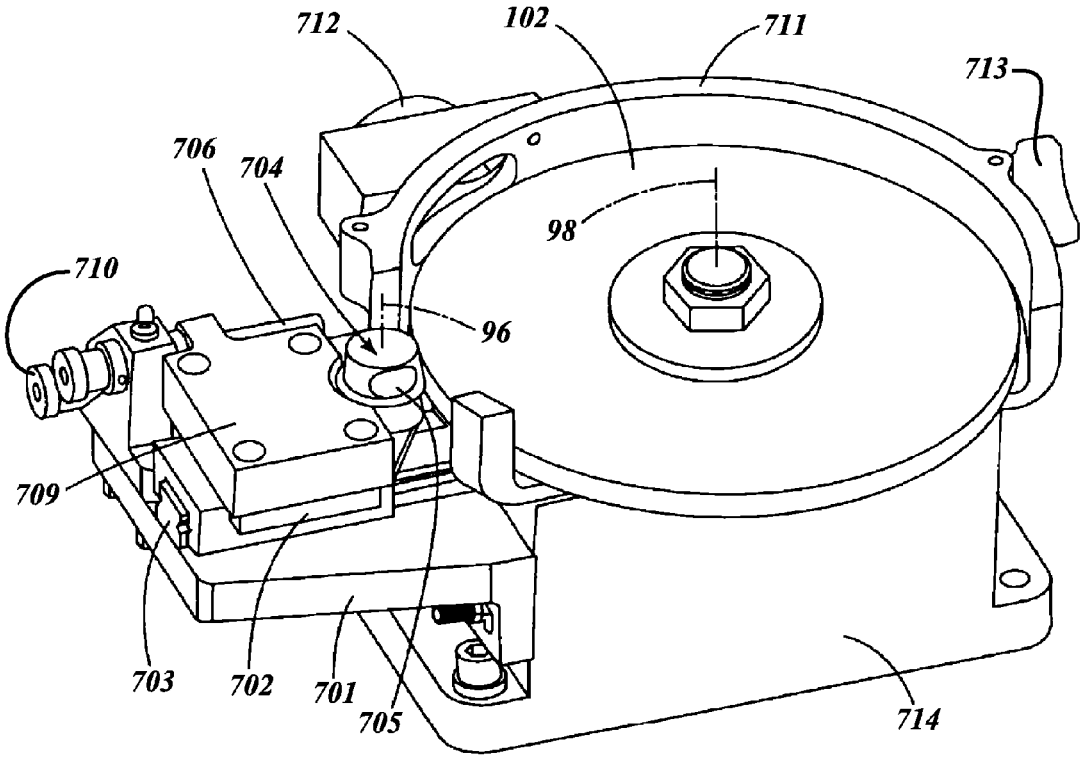
FIG. 10 is an isometric view showing the rotating contouring tool mounted on a spindle of a skate blade sharpening machine to allow easy interchange of rotating contouring tools in accordance with the present teachings.

FIG. 9 shows another preferred embodiment of a rotating contouring tool, sometimes referred to as a crush roll contouring tool 704. Contouring tool 704 has a contour surface 601, a bearing assembly 603, and retaining ring 602. FIG. 10 shows the crush roll contouring tool 704 rotatably mounted about axis 96 on a skate sharpening machine. The tool 704 is mounted on a vertical spindle that is attached to a metal plate, 709. The metal plate 709 is attached to a linear ball slide table 702 which rides on a ball slide rail 703, allowing the tool to be adjusted towards and away from the axis of rotation 98 of the grinding wheel 102. The ball slide rail 703 is firmly affixed to a bracket 701 that provides a rigid link to a skate sharpening machine spindle housing 714. This rigid link is used to absorb the force generated when the crush roll contouring tool 704 is forced into the engagement position, i.e., into contact with the grinding wheel 102 through the action of a lead screw 706 on the heavy metal plate 709. The rotation of the lead screw 706 is accomplished by turning the adjusting knob 713, which is linked to the lead screw 706 through a timing belt drive system. Also shown in FIG. 10 are a guard 711 and a dust collection port 712.

Figure 11:
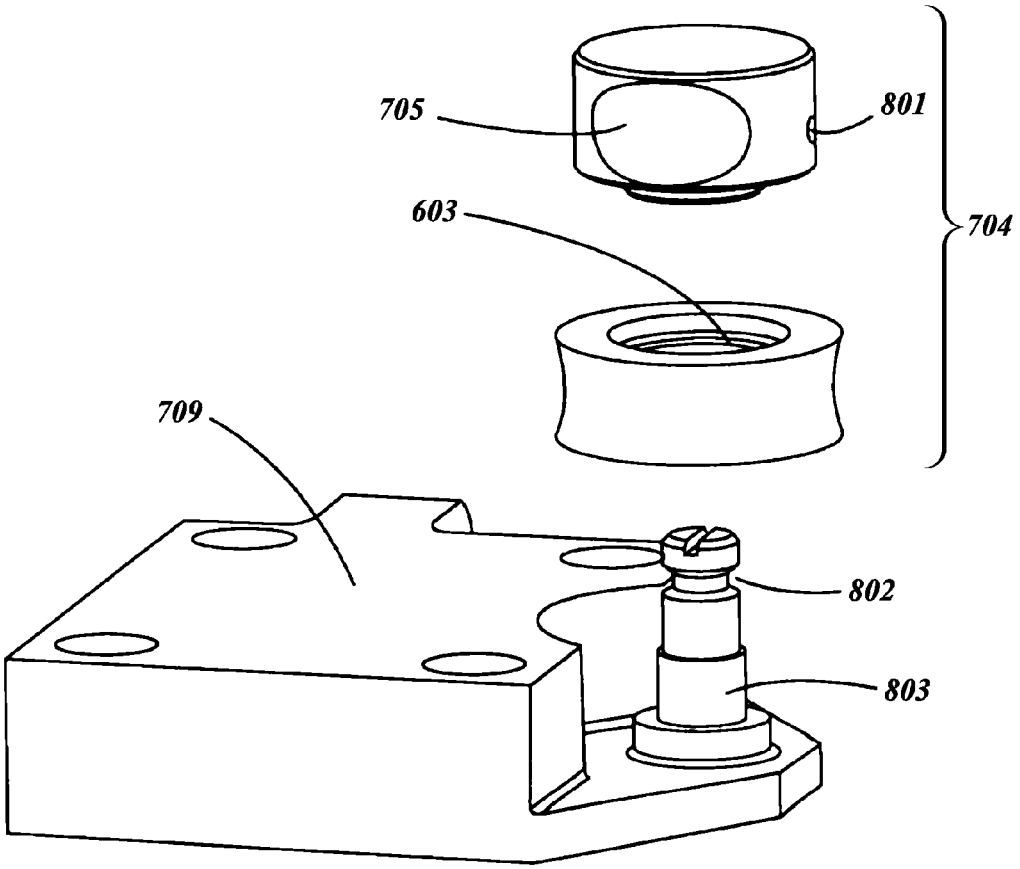
FIG. 11 is an exploded isometric view of the rotating contouring tool on the spindle in accordance with the present teachings.

With reference to FIGS. 10 and 11, easy interchange of the crush roll contouring tool 704 is helped by the use of a ball plunger 801 located in a retainer 705. The retainer provides for positive vertical location of the crush roll contouring tool 704 with respect to the heavy metal plate 709 during operation. The heavy metal plate 709 is designed to be sufficiently massive so that it can resist vibrational loading of the grinding wheel and the crush roll contouring tool. When in the engaged position, the contouring tool rotates against the grinding wheel about its axis 96 and is held in place with respect to the grinding wheel axis 98.

FIG. 11 shows an exploded view of the retainer 705, spindle 803, contouring tool 704, and heavy metal plate 709. The retainer 705 is typically held in place by a ball plunger 801 that locates in a groove 802 in the spindle 803. Once the retainer 705 is lifted off the spindle 803 the crush roll contouring tool 704 can be easily removed and replaced with a different tool.

Figure 12:
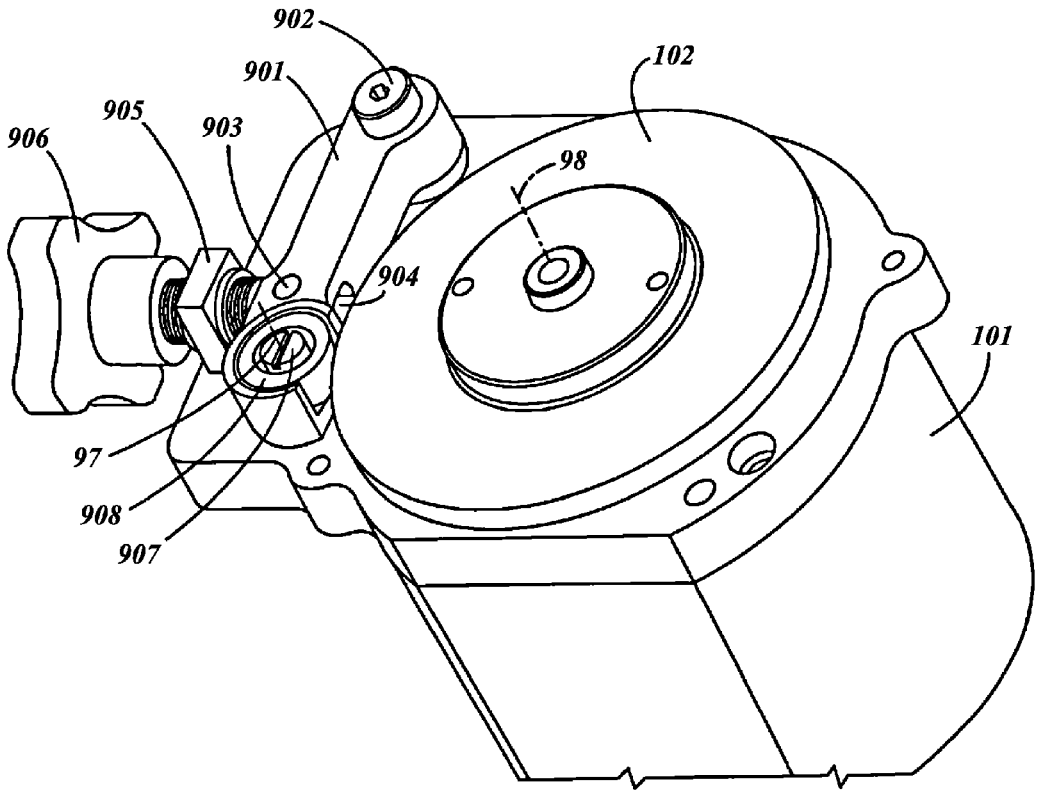
FIG. 12 is a partial isometric view showing the rotating contouring tool mounted on a pivot arm so that it can be fed into the grinding wheel in accordance with the present teachings.

FIG. 12 shows an alternative preferred embodiment of an ice skate blade sharpening machine. This embodiment is advantageous in terms of its compactness and is therefore desirable for use in portable or smaller ice skate blade sharpening machines. A crush roll contouring tool 908 is mounted on a screw that serves as the spindle 907 and is screwed onto a pivot arm 901. This pivot arm is anchored to a mounting plate that also is attached to the motor housing 101 via a shoulder screw 902. Since the shoulder screw 902 is oriented with its axis parallel to the axis of the grinding wheel, the movement of the crush roll contouring tool 908 is in the same plane as the plane of the grinding wheel 102. Movement of the pivot arm 901 is accomplished by turning a knob 906 which turns a lead screw 904 in a threaded barrel pin 903, pushing the pivot arm 901 forward. The force required to push the pivot arm 901 forward is absorbed by a pivot block 905. This allows for the rotation created by the movement of the pivot arm 901. Preferably the pivot arm 901 is heavy, as its inertia helps damp out vibrations between the grinding wheel 102 and the crush roll contouring tool 908.

It will be understood here by those skilled in the art that the contouring tool is held in place with respect to the grinding wheel axis in the sense although there may be some vibrational movement as the contouring tool engages the grinding wheel periphery, the contouring tool is staying in the same plane with respect to the grinding wheel axis while in the engaged position. In the preferred embodiments shown in the drawings, the contouring tool 103 in FIG. 2 is held in place on the pivot arm; in FIG. 5, although the indexable contouring tool 501 is adjustable, it is held in place while in the engaged position; and in FIG. 7, although the contouring tool 704 is rotatable about its axis 96 while in the engaged position, it is held in place with respect to the grinding wheel axis 98.

Figure 13:
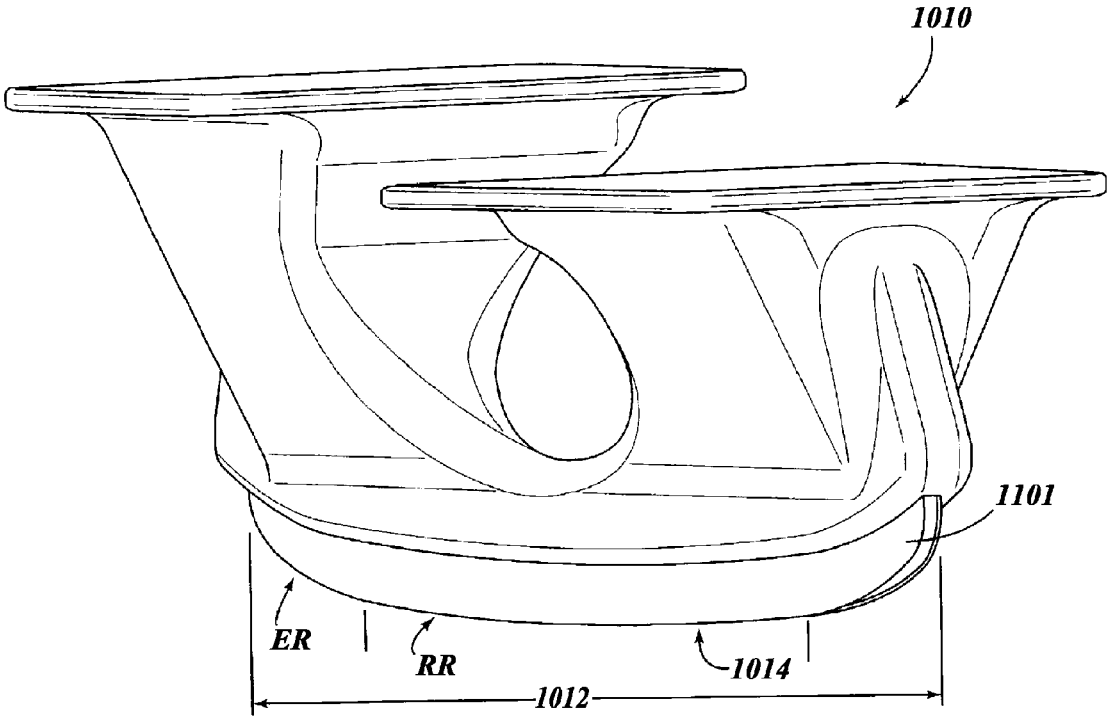
FIG. 13 is an isometric view of an ice skate blade in accordance with another aspect of the present teachings.
Figure 14:
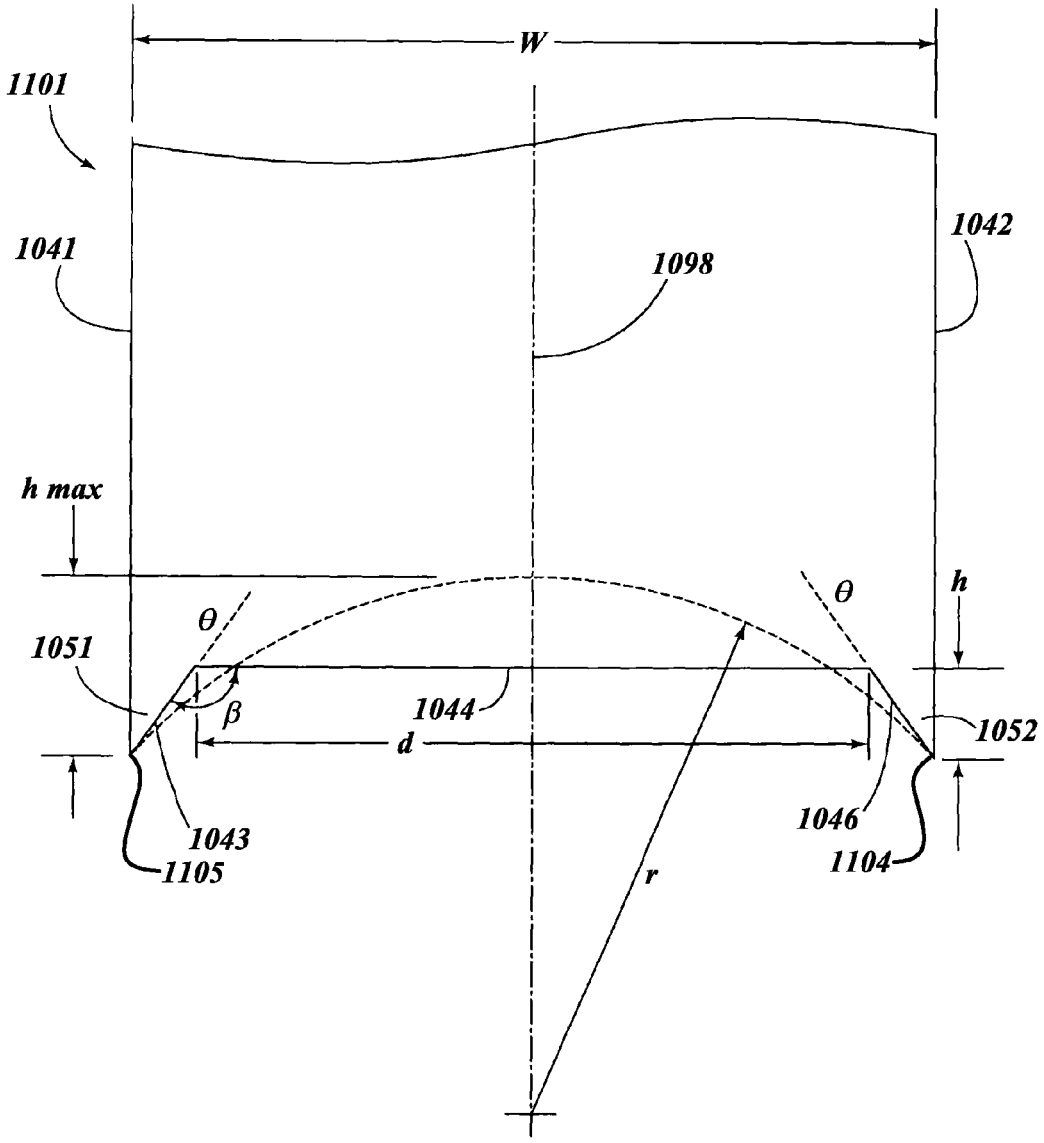
FIG. 14 is a diagram of a cross-section through an ice skate blade in accordance with one aspect that has a flat bottom vee profile on a bottom of the ice skate blade in accordance with the present teachings.

FIGS. 13 and 14 show an ice skate 1010 having an ice skate blade 1101 in accordance with one embodiment. The blade has a long length 1012 and a shorter width W generally perpendicular to the length. The length may have a rocker radius RR portion and may also have a portion near the ends with a second radius or entry radius ER. Preferably the ice engaging surface 1014 has a profile or cross section which is generally the same across its length, and at least across the rocker radius portion of the length. The particular blade profile here may be especially suited for hockey. Alternate ice skate blade profiles, such as those used for speed skating, may be largely flat or have a minimal rocker radius.

FIG. 14 shows a profile or cross-section through the rocker radius of the ice skate blade 1101 with a circular arc or arc-shaped groove of radius r is shown in phantom for reference. The phantom groove is not part of the invention, but is shown for contrast as it is the typical shape ground into an ice engaging surface of known ice skate blades using the current technology for sharpening—a cutting tool swung in an arc around a single point. The profile of FIG. 14 can be referred to as the flat bottom vee (abbreviated to FBV) because the two flats 1043, 1046 would intersect in a vee shape if they were projected upward, and a bottom 1044 of the ice skate blade 1101 forms a bottom for the vee shape resulting from that projection.

The width of the ice skate blade, w, is the distance between the two generally vertical side edges 1041, 1042 of the ice skate blade 1101. The height under the blade, h, is the vertical distance (with vertical understood to be as shown in FIG. 14) between the bottom 1044 and bottom ends 1105, 1104 of the two blade edges 1041, 1042 respectively. Vees 1051, 1052 are defined by side edge 1041 and flat 1043 and by side edge 1042 and flat 1046. As shown in FIG. 14, the two flats 1043, 1046 may be formed along lines tangent to the circular arc at the bottom ends 1105 and 1104, respectively. The vees 1051, 1052 are defined by an acute edge angle θ between the flats 1043, 1046 and side edges (walls) 1041, 1042, respectively. A flat angle β is formed between each flat 1043, 1046 and the bottom 1044. As shown here, the edge angle θ on both sides of the profile are equal to one another, and the bottom is centered around a centerline 1098 of the ice skate blade.

As was noted in the background, the edge angle θ and the maximum height $h_{max}$ under the ice skate blade 1101 can advantageously be varied by relating the edge angle with the blade width, w, and the groove arc radius r. There are a few geometric properties that define the shape of the flat bottom vee ice skate blade profile; the blade width, w, the width of the bottom, d, and the depth of the bottom, h. The edge angle θ at the blade edge, in the case of a symmetrical (central to the blade width) location of the blade bottom 1044 (as shown in FIG. 14) is given by the following formula:

$$\theta = a\tan\{(w-d)/2h\} \tag{3}$$

As can be seen from this formula; once a blade width, w, is known, a value of blade bottom width, d, can be chosen in conjunction with the depth of the flat, h, to obtain a wide range of desirable edge angle θ values in accordance with the present teachings. For example an ice skate blade 1101 having a bottom width d of 0.090 inches can have a depth of flat h of 0.00075 inches. Testing of hockey ice skates with bottom vee profiles has shown that superior ice skating performance can be achieved using bottom vee designs with a width of 0.110" and the bottom distanced ranges from 0.080" to 0.105", and the height is 0.001" to 0.0005". It will be readily apparent to those skilled in the art that the bottom 1044 does not have to be perfectly flat but only flat within the manufacturing and machining tolerances associated with crush roll forming tool, its abrasive coating, and the profile transfer processes associated with dressing the grinding wheel and grinding the ice skate blade according to the tooling and process discussed herein.

Figure 15:
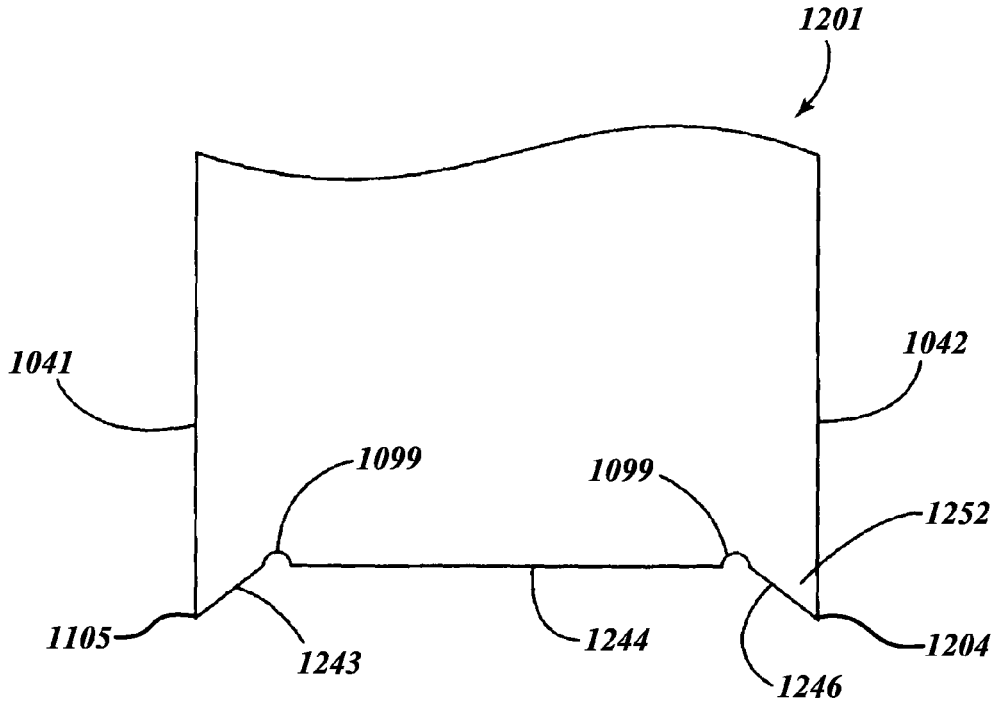
FIG. 15 is a diagram showing a further aspect of the present teachings with a flat bottom vee profile where relief pockets are formed in the bottom of the blade.

FIG. 15 shows another embodiment where the profile or cross-section of an ice skate blade 1201 is shown with the bottom vee profile of FIG. 14 with the addition of relief pockets 1099 between a blade bottom 1244 and flats 1245, 1246. The relief pockets advantageously help provide an ice chip breaking type action when a user pushes off and provide greater control during stopping. The relief pockets 1099 are shown formed as semi-cylinders with a circular arc cross-section; other shapes will be readily apparent to those skilled in the art given the benefit of this disclosure.

Figure 16:
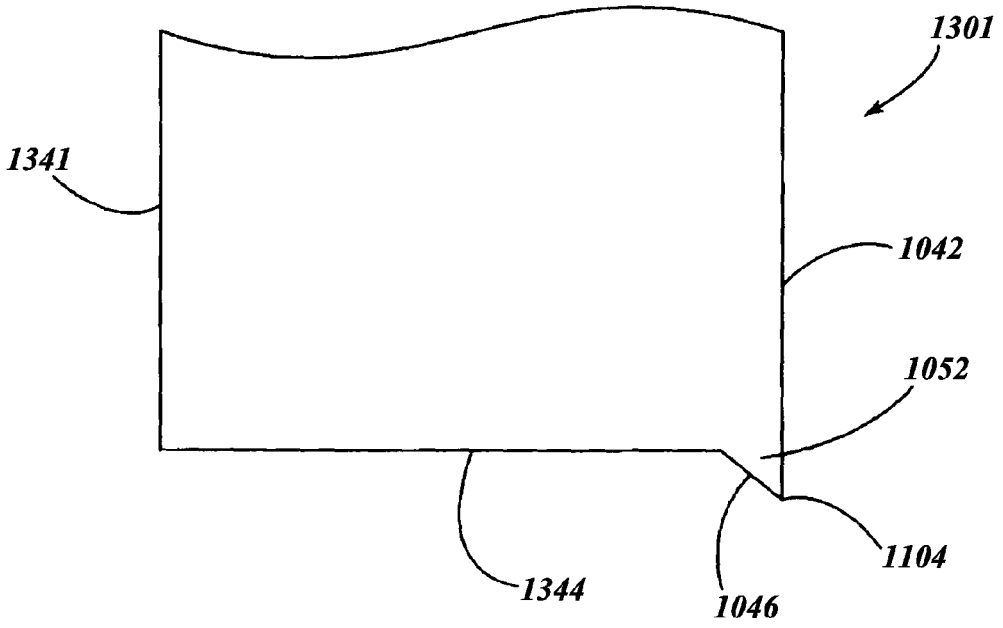
FIG. 16 is similar to FIG. 15 and shows a single vee in accordance with a further aspect of the present teachings.

FIG. 16 shows another embodiment where the profile or cross-section through an ice skate blade 1301 is asymmetrical. Side edge 1042 with a bottom end 1104, the flat 1046, and the vee 1052 remain the same as the embodiment in FIG. 14. However, side edge 1341 does not have a bottom end which helps define a vee. Bottom 1344, instead of extending between flats, now extends between one flat 1046 and one of the side edges 1341. The profile of FIG. 16 has the profile of FIG. 14 on one side only. The height is measured in a manner similar to the embodiment of FIG. 14. As the bottom 1344 is linear in cross-section (and curved along the length), a vertical distance is defined between a point formed by a line extending collinearly from the bottom 1344 to the side edge 1042 and the bottom end 1104 as shown in FIG. 16. The profile of FIG. 16 has significant potential for speed skating, where all of the turns are in one direction and the blade side edge 1042 can be used on the inside edge of the skate blade to provide greater cornering ability. The presence of the blade side edge will provide greater drag than the completely flat blades presently used for speed skating. However, the improved ability to corner as well as the better ability to push off during power strokes will provide superior performance to speed skaters.

Figure 17:
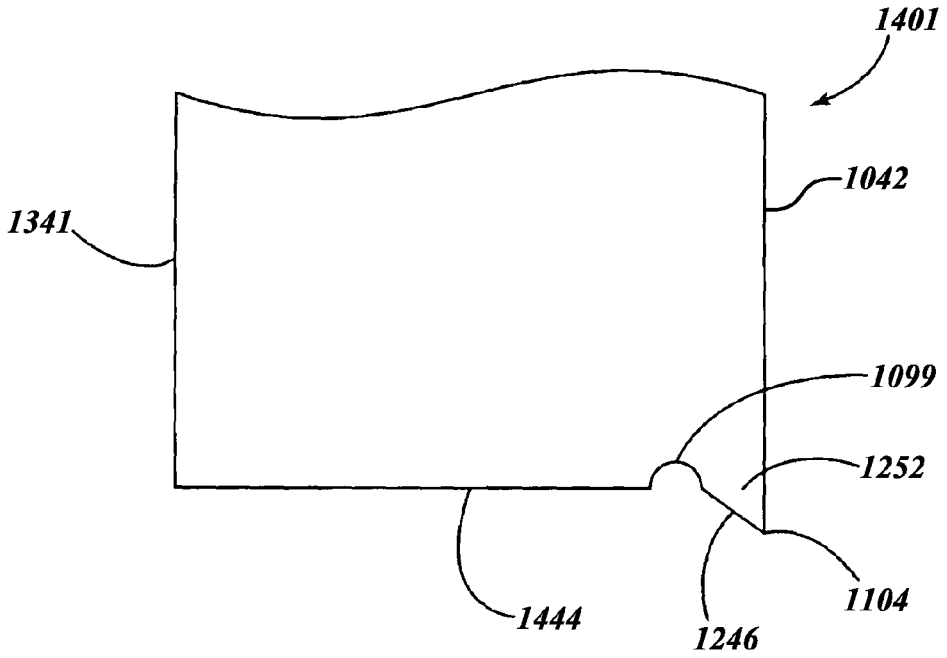
FIG. 17 is similar to FIG. 15 and shows a single vee with a relief pocket in accordance with another aspect of the present teachings.

FIG. 17 is another embodiment similar to FIG. 16, most suitable for speed skating, with the addition to the ice skate blade 1401 of one of the relief pockets 1099 of FIG. 15 between the blade bottom 1344 and one of the flats 1243, 1246. The relief pocket advantageously helps provide an ice chip breaking type action when a user pushes off and provide greater control during stopping.

Figure 18:
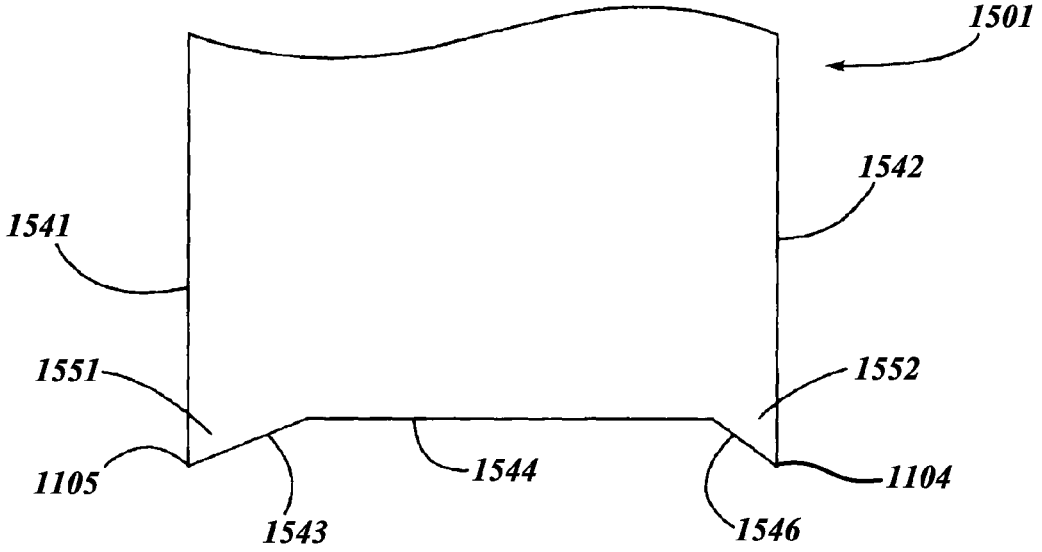
FIG. 18 is similar to FIG. 15 and shows non-identical edge angles in accordance with yet another aspect of the present teachings.

FIG. 18 shows another embodiment of a profile or cross-section through an ice skate blade 1501 wherein vees 1551, 1552 and therefore edge angles between flats 1543, 1546 and a bottom 1544 are not the same. The bottom 1544 of the blade profile is not symmetrical with respect to the blade centerline established as the half way point between the two blade side edges 1541, 1542. It is anticipated that the ice skate blade profile shown in FIG. 18 with a first blade edge angle different than a second edge angle would provide improved performance for a hockey goalie, particularly if the sharper edge is on the inside of both skate blades, allowing for better penetration of the ice to provide a stronger side ways push during lateral goalie movements.

Figure 19:
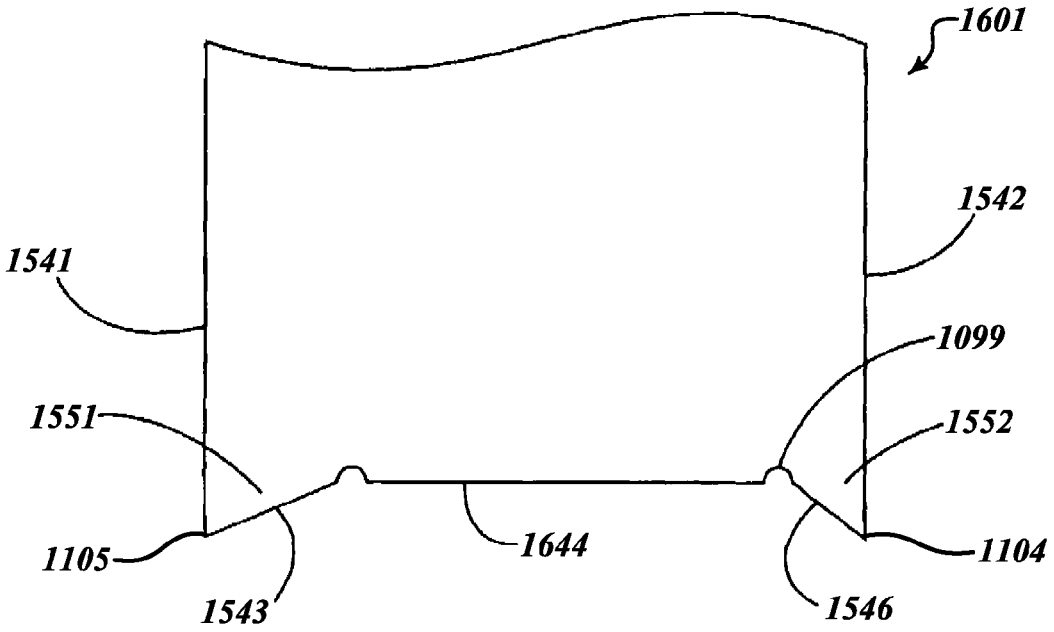
FIG. 19 is similar to FIG. 15 and shows non-identical edge angles with relief pockets in accordance with another aspect of the present teachings.

FIG. 19 is another embodiment similar to FIG. 18, with the addition to the ice skate blade 1601 of the relief pockets 1099 of FIG. 15 between the blade bottom 1644 and the flats 1543, 1546. The relief pockets advantageously help provide an ice chip breaking type action when a user pushes off and provide greater control during stopping.

Figure 20:
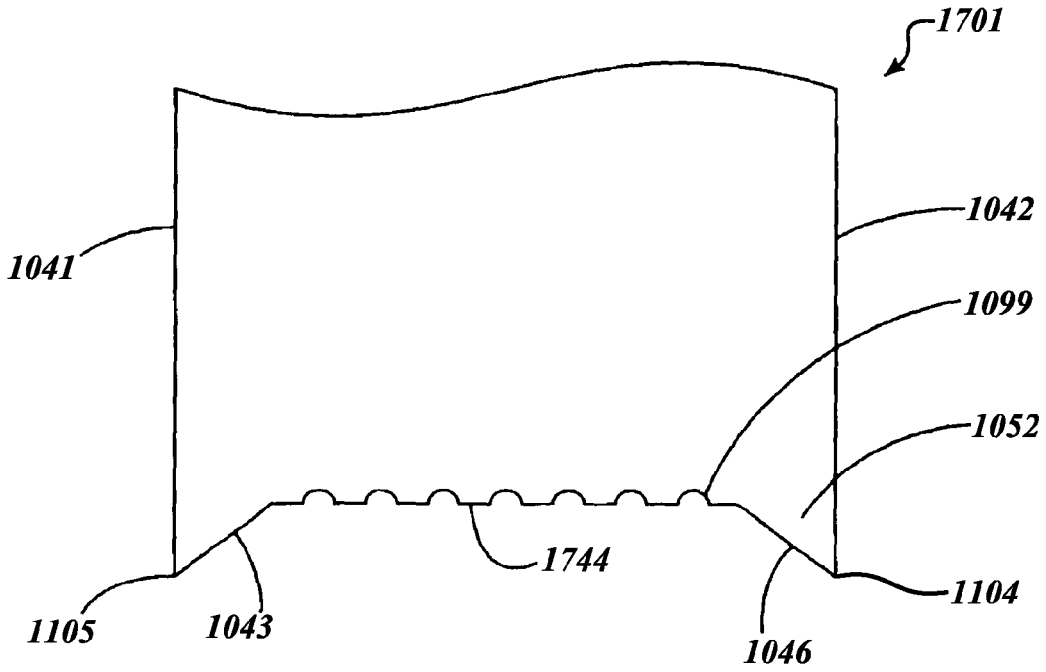
FIG. 20 is similar to FIG. 15 and shows a bottom vee profile with a multiplicity of relief grooves ground into the bottom of the blade in accordance with another aspect of the present teachings.

FIG. 20 shows another embodiment of a profile or cross-section through an ice skate blade 1701 with the symmetrical bottom vee profile of FIG. 14 and the additional feature of a plurality of relief pockets 1099 across the width of the bottom 1744. The number, location, depth, and precise shape of the relief pockets can be varied dependent upon the exact effect required. The relief pockets are present for two purposes: to provide channels for the passage of water and to provide passages for ice chips or other debris on the ice surface. While the presence of multiple relief pockets in the blade bottom is shown for the bottom vee profile it will be readily understood by those skilled in the art and given the benefit of this disclosure that multiple relief pockets may be applied to the bottom of any of the other blade groove profiles disclosed herein.

Figure 21:
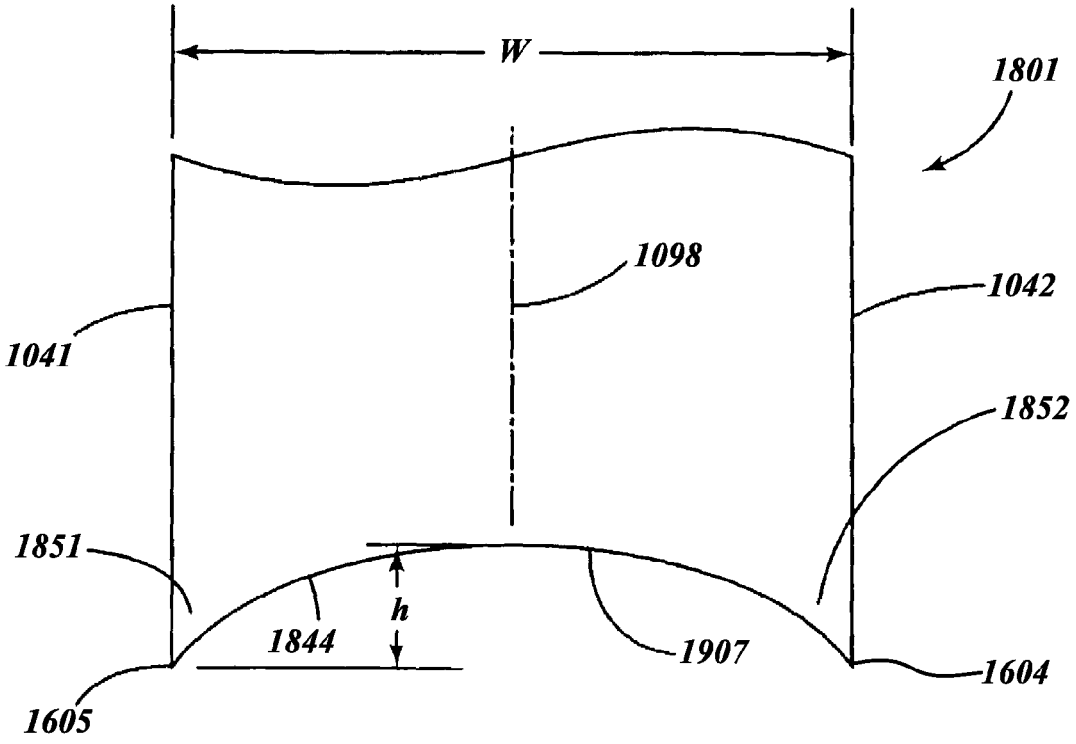
FIG. 21 is similar to FIG. 14 and shows a bottom of an ice skate blade having an elliptical cross-section in accordance with an alternative aspect of the present teachings.

FIG. 21 shows another embodiment of an ice skate blade 1801 having an elliptical bottom 1844 combining the bottom and the flats of other embodiments. Ellipses have a major axis and a minor axis. The major axis is on the line formed between the two blade side edges 1041, 1042, while the minor axis is on the centerline of the skate blade, half way between the side edges of the blade. For an elliptical shape that has an x-axis defined along the line joining the two blade side edges and a y-axis located along the centerline 1098 of the blade, it is possible to describe the profile in mathematical terms as:

$$(2x/w)^2+(y/h)^2=1 \tag{4}$$

Where: w is the width of the ice skate blade 1801 and h is the maximum height of the profile under the skate blade or more precisely a vertical distance between a line tangent to the ellipse at the centerline and a line formed between the bottom ends 1604, 1605. The variables x and y are understood to be standard references with respect to the view in FIG. 21. Since the value of the height of the profile under the blade h can be varied independently from the blade width, w, it is possible to create ice skate blade profiles, 1801, with any value of height, h, under the blade, all with edge angles of zero.

There are however two practical considerations that must be addressed in grinding an elliptical profile 1601 on the bottom of the ice skate blade 1101. These practical considerations are: first, the width, w, of all skate blades has a nominal value for each of the ice sports. In hockey, hockey goalie, figure skating, and speed skating, there is variation in tolerance for the blade width w within each sport classification. Also, an edge angle of 0° is not practical as it will have zero width at the blade side edge, with a resultant tendency for the edge to break off. In order to overcome these limitations in a practical manner, the x axis of the ellipse described above can be lowered by an amount d below the line joining the two blade bottom edges 1604, 1605, and the length of the elliptical axis along the x axis can be increased by an amount 2*a*. This ellipse will have the following equation:

$$\{x/(w/2+a)\}^2+\{y/(h+d)\}^2=1 \tag{5}$$

Where all of the terms in the equation for the ellipse are defined as noted above. The blade bottom edges 1604, 1605, will be located at the coordinate points (w/2, d) and (−w/2, d). The edge angle θ can then be calculated as:

$$\theta=90°+a\tan[(h+d)\{[(w/2)/(w/2+a)]/[1-[(w/2)/(w/2+a)]^2]^{1/2}\}] \tag{6}$$

The edge angle θ is shown below to have a preferred range of about 62° to 87° for several combinations of a, d, h, with w=0.110 inches as is typical for hockey skates.

| distance, d (inches) | distance, a (inches) | depth, h (inches) | edge angle, θ (degrees) |
|---|---|---|---|
| 0.010 | 0.001 | 0.001 | 62.20 |
| 0.010 | 0.002 | 0.001 | 69.64 |
| 0.050 | 0.003 | 0.001 | 73.21 |
| 0.050 | 0.001 | 0.001 | 75.09 |
| 0.050 | 0.002 | 0.001 | 79.39 |
| 0.050 | 0.003 | 0.001 | 81.34 |
| 0.020 | 0.001 | 0.001 | 83.74 |
| 0.020 | 0.002 | 0.001 | 85.59 |
| 0.020 | 0.003 | 0.001 | 86.41 |

The fact that the height under the profile h, and the edge angle (θ), can be varied independently allows elliptical profiles 1601, to be selected that can provide superior performance over known circular arc profiles.

Figure 22:
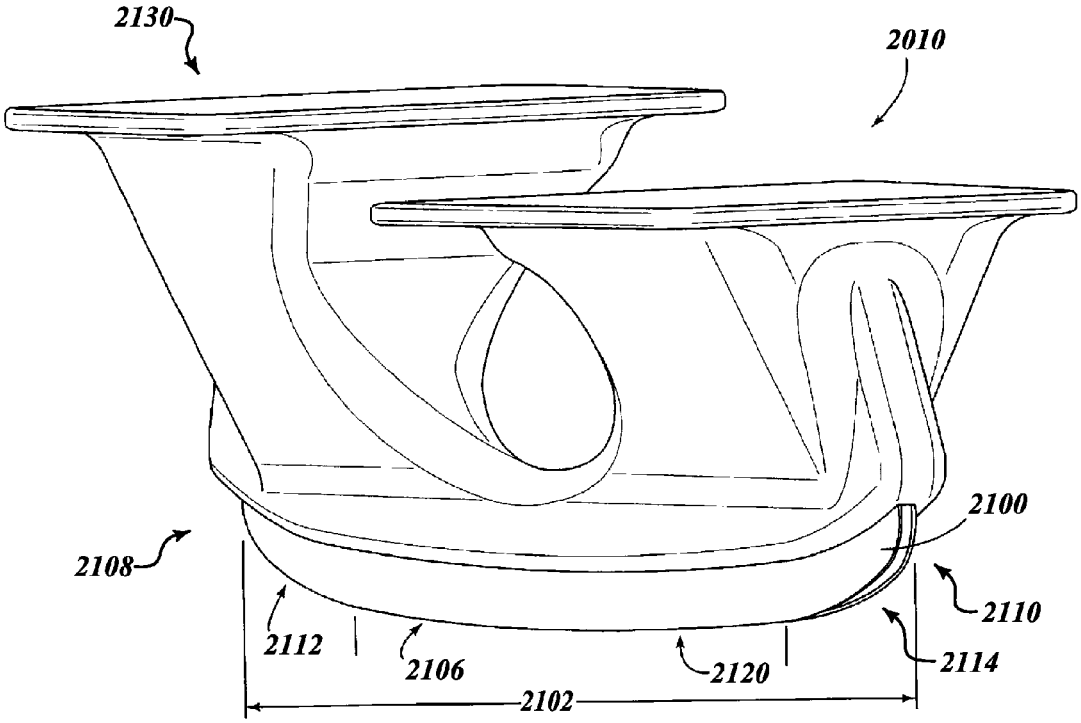
FIG. 22 is an isometric view of an ice skate blade in accordance with a further aspect of the present teachings.
Figure 23:
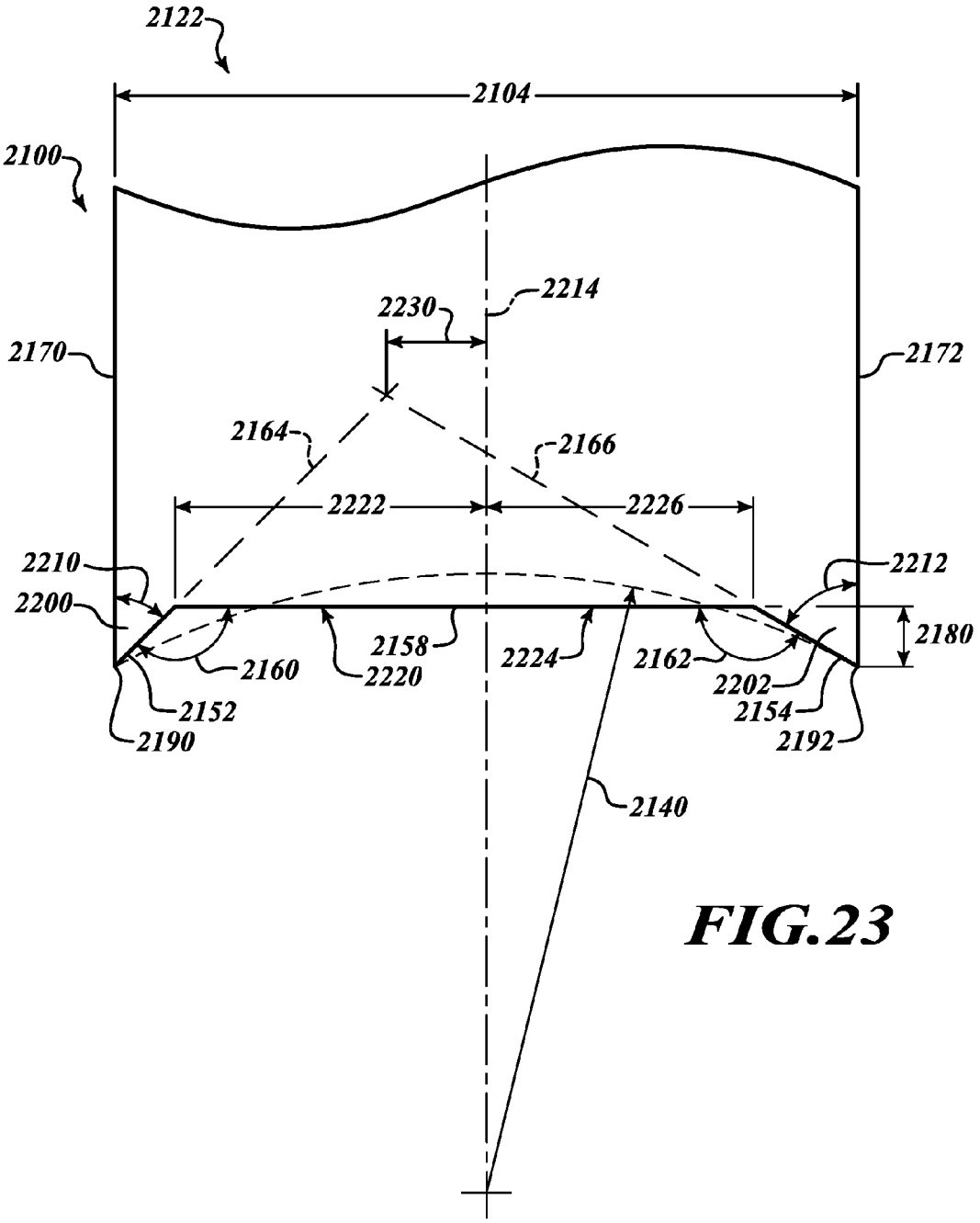
FIG. 23 is a diagram of a cross-section through the ice skate blade of FIG. 22 in accordance with the present teachings.
Figure 24:
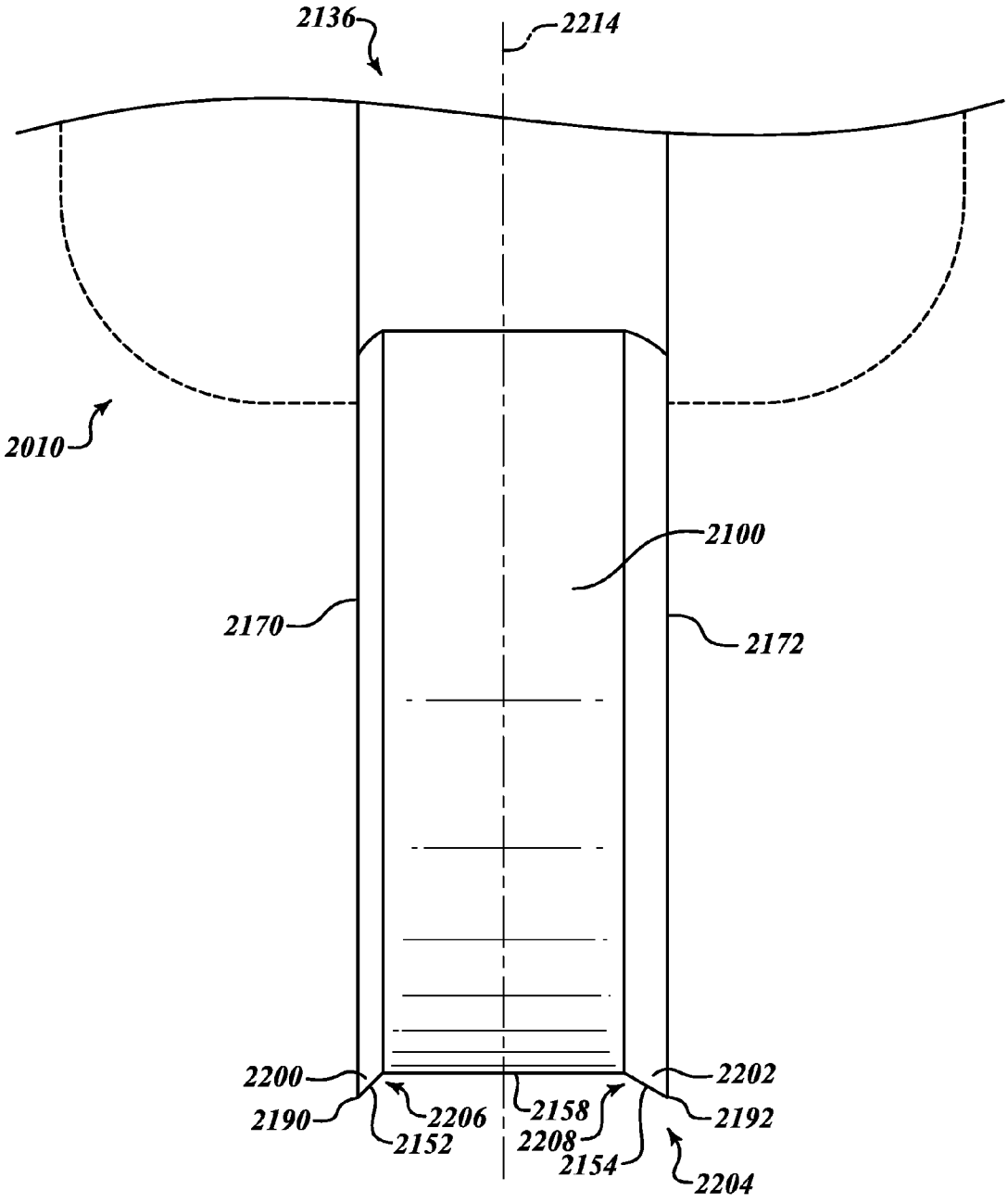
FIG. 24 is a partial front view of the ice skate blade of FIG. 22 in accordance with the present teachings.

FIGS. 22, 23, and 24 show an ice skate 2010 having an ice skate blade 2100 in accordance with further aspects of the present teachings. The ice skate blade 2100 includes a long length 2102 and a shorter width 2104 generally perpendicular to the long length 2102. With reference to FIG. 23, the long length 2102 can have a rocker radius portion 2106. Each of the ends 2108, 2110 of the long length 2102 can have an entry radius 2112, 2114. An ice engaging surface 2120 of the ice skate blade 2100 has a profile 2122—shown in cross-section in FIG. 23. The engaging surface 2120 that contacts the ice is opposite a portion of the ice skate blade 2100 that can connect to the boot and support structure 2130.

In certain aspects of the present teachings, the profile 2122 can be generally the same across its length. The profile 2122 can extend at least across the rocker radius portion 2106 of the long length 2102. It can be shown that the particular blade profile 2122 of the ice skate blade 2100 may be especially suited for hockey. Moreover, it can be shown that the particular blade profile 2122 may be especially suited for the goalie position. In contrast, alternate ice skate blade profiles—such as those used for speed skating—may be largely flat or have a minimal rocker radius.

FIG. 23 illustrates the profile 2122 through the rocker radius portion 2106 of the ice skate blade 2100. A circular arc or arc-shaped groove of a radius 2140 is shown in broken line for reference. The arc-shaped groove of the radius 2140 is not part of the invention, but is shown for contrast as it is the typical shape ground into an ice engaging surface of known ice skate blades using current technology for sharpening, e.g.: a cutting tool swung in an arc around a single point.

In certain aspects of the present teachings, the profile 2122 can have a skewed A-shape 2156 in that a first flat 2152 and a second flat 2154 can intersect and form the skewed A-shape 2156 (FIG. 23) when the flats 2152, 2154 are projected (in an imaginary sense) upward opposite the engaging surface 2120. A flat bottom portion 2158 of the ice skate blade 2100 can form a portion of the A-shape 2156 in cooperation with the first flats 2152 and its flat angle 2160 and the second flat 2154 and its flat angle 2162. It will be appreciated in light of the disclosure that the flat angles 2160, 2162 can be of different values such that the A-shape can be offset to various degrees. In this regard, a first line 2164 is parallel to the first flat 2152 and is transverse to a second line 2166 that is parallel to the second flat 2154. In this arrangement, the flat angles 2160, 2162 can meet the flat bottom portion 2158 at purposeful angles and therefore do not form curved surfaces. It can be shown that the value of the flat angles 2160, 2162 can be purposefully adjusted to achieve an increase in performance of the skater. This can be relative to a conventional arrangement where: the flats 2152, 2154 are imotted and that area is not flat but has a curved shape similar to the arc-shaped groove of the radius 2140.

The width 2104 of the ice skate blade 2100 is the distance between two generally vertical sides 2170, 2172 of the ice skate blade 2100. The ice skate blade 2100 can define a height 2180 that can be a vertical distance (with vertical understood to be as shown in FIG. 23) between the flat bottom portion 2158 of the profile 2122 and ends 2190, 2192 at the bottom of the two vertical sides 2170, 2172, respectively. With reference to FIGS. 22 and 24, the vertical sides 2170, 2172 run the long length 2102 of the ice skate blade 2100. The end 2190 between the first flat 2152 and the vertical side 2170 can extend along the long length of the ice skate blade 2100 as an edge 2194. The end 2190 between the second flat 2154 and the second vertical side 2172 can extend along the long length 2102 of the ice skate blade 2100 as an edge 2196.

A first vee portion 2200 can be defined by a combination of the first vertical side 2170, the first flat 2152, and the end 2190. The first vee portion 2200 can extend along the edge 2194. The second vee portion 2202 can be defined by a combination of the second vertical side 2172, the second flat 2154, and the second bottom end 2192. The second vee portion 2202 can extend along the edge 2196. At a distance, the vee portions 2200, 2202 can appear to be fangs 2204, as shown in FIG. 24. The fangs 2204 can have angular sides 2206, 2208 that include the vee portions 2200, 2202. The angular sides 2206, 2208 of the fangs 2204 can be different (i.e., not identical). This is in contrast to the flat bottom vee profile illustrated in FIG. 14 that also includes fangs that are identical.

The fangs 2204 in combination with other portions of the ice skate blade 2100 as shown in FIGS. 22, 23, and 24, can be shown to provide the increased performance. The fangs 2204 can also have a separate ornamental appearance. The fangs 2204 can also have an ornamental appearance alone or in combination with one or more portions of the ice skate blade 2100. It will be appreciated in light of the disclosure that the ornamental appearance is separate from the functional aspects of the present teachings.

It will be appreciated in light of the disclosure that the second vee portion 2202 can be larger than the first vee portion 2200. As such, the second flat angle 2162 can be larger than the first flat angle 2160. Because of the values of the flat angles 2160, 2162, a first edge angle 2210 can be smaller than a second edge angle 2212. The first edge angle 2210 is the included angle between the first vertical side 2170 and the first flat 2152. The second edge angle 2212 is the included angle between the second vertical side 2172 and the second flat 2154. It can be shown that the ice skate profile shown in FIG. 23 with the first vee portion 2200 and the second vee portion 2202 being sized differently can provide improved performance for a hockey goalie, particularly when the sharper edge (i.e., the narrower vee) is on the inside of both skate blades. It can be shown that the increased performance can be due to better penetration of the ice to provide relatively stronger side-ways push during lateral goalie movements.

In contrast to the first vee portion 2200 and the second vee portion 2202 illustrated in FIGS. 23 and 24, FIG. 14 illustrates another aspect of the present teachings in that the edge angle $\theta$ on both sides of the profile and the flat angles $\beta$ on both sides of the profile can be equal to one another. Moreover, in FIG. 14 the blade bottom 1044 can be centered about the centerline 1098 of the ice skate blade 2100.

Returning to FIGS. 23 and 24, the flat bottom portion 2158 need not be centered about a centerline 2214 of the ice skate blade 2100. The flat bottom portion 2158 can define a first portion 2220. The first portion 2220 can define a distance 2222 between where the first flat 2152 can contact the bottom portion 2158 and the centerline 2214. The flat bottom portion 2158 can also define a second portion 2224. The second portion 2224 can define a distance 2226 between where the second flat 2154 can contact the flat bottom portion 2158 and the centerline 2214. In this arrangement, a value of the first distance 2222 can be different than a value of the second distance 2226. As such, the first line 2164 and the second line 2166 can form an intersection 2230. The intersection 2230 can be spaced a distance 2232 from the centerline 2214.

Figure 25:
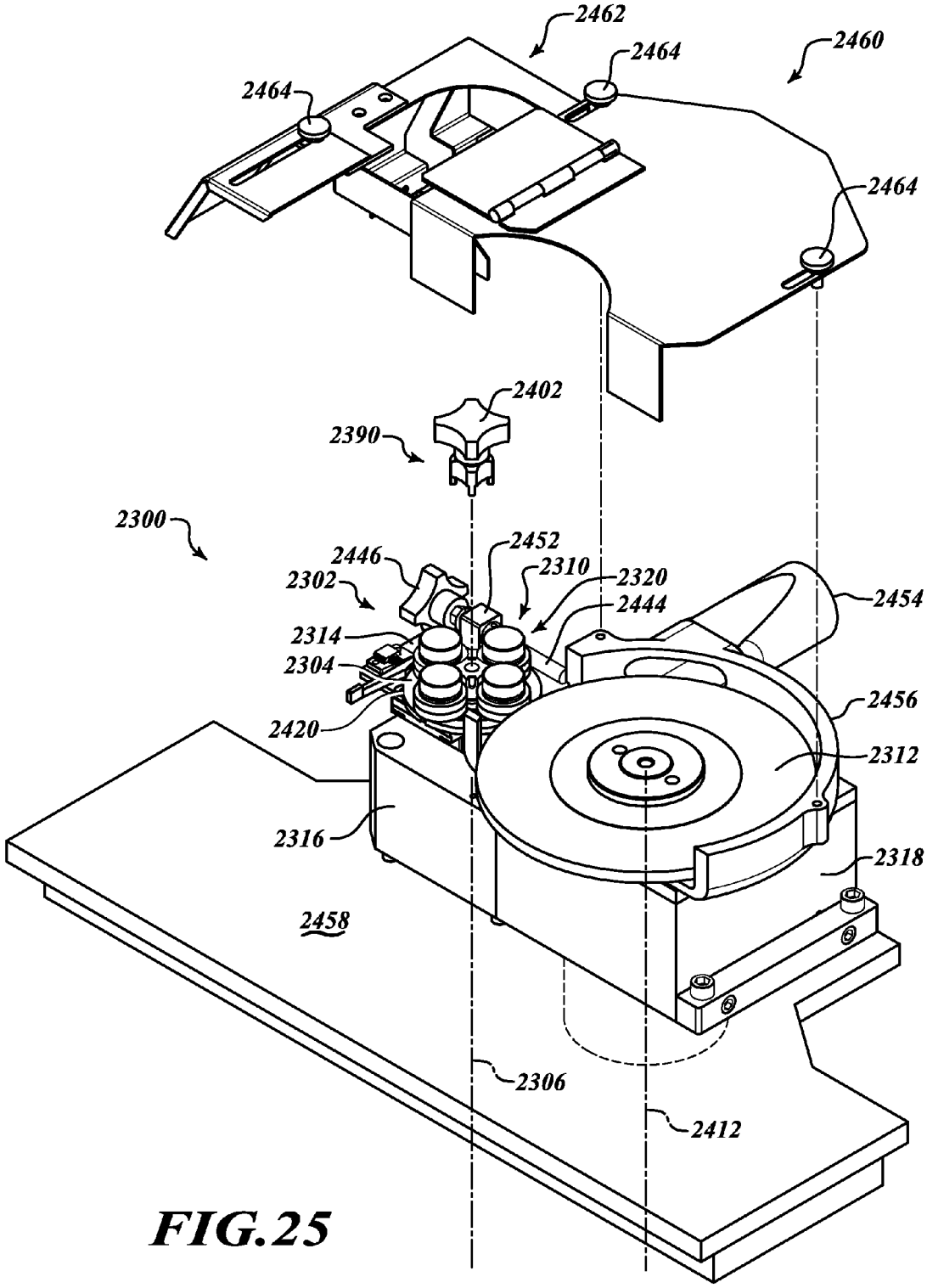
FIG. 25 is an isometric view showing multiple rotating contouring tools mounted on a rotatable carousel that is connected to a housing of a skate blade sharpening machine in accordance with the present teachings.

With reference to FIGS. 25-28, an exemplary blade sharpening machine 2300 can be shown with an adjustment device 2302 in accordance with another aspect of the present teachings. The adjustment device 2302 can include a carousel 2304 that can rotate about an axis 2306. The carousel 2304 can hold one or more contouring tools 2310 to be used to dress a grinding wheel 2312 on the blade sharpening machine 2300. The carousel 2304 can be mounted to a tray 2314 and the tray 2314 can connect to an accessory housing 2316 (FIG. 25). The accessory housing 2316 can be coupled to or can be unitarily constructed with a housing 2318 of the blade sharpening machine 2300.

Figure 26:
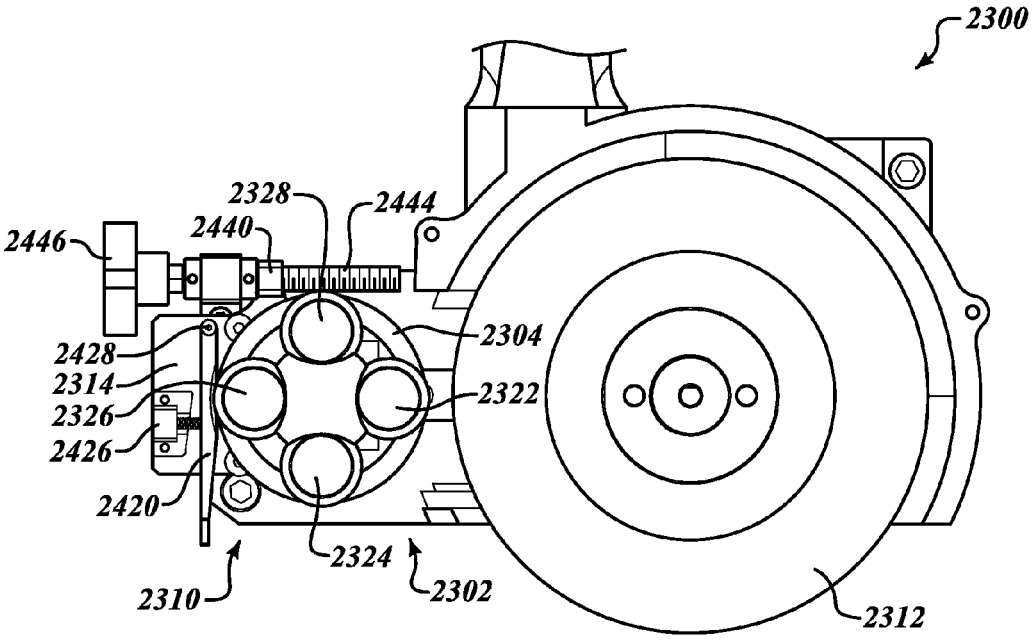
FIG. 26 is a partial top view of FIG. 25 showing a feed axis relative to the carousel and a grinding wheel in accordance with the present teachings.

The carousel 2304 can be mounted on the tray 2314 so as to be rotatable amongst a plurality of positions. For example, there can be four positions that can correspond to four rotatable contouring tools 2310—also referred to herein as spinners 2320—that can be mounted onto the carousel 2304. With reference to FIG. 26, the spinners 2320 can include a first spinner 2322, a second spinner 2324, a third spinner 2326, and a fourth spinner 2328. A user selects one of the spinners 2320 on the carousel 2304 and the carousel 2304 can be rotated to the corresponding position and advanced toward the grinding wheel 2312 to engage and dress the grinding wheel 2312. The selected spinner, for example, can dress the grinding wheel 2312 to a grinding wheel contour indicative of the first spinner 2322. The user can select another of the spinners 2320 and therefore dress the grinding wheel 2312 to another grinding wheel contour.

Figure 28:
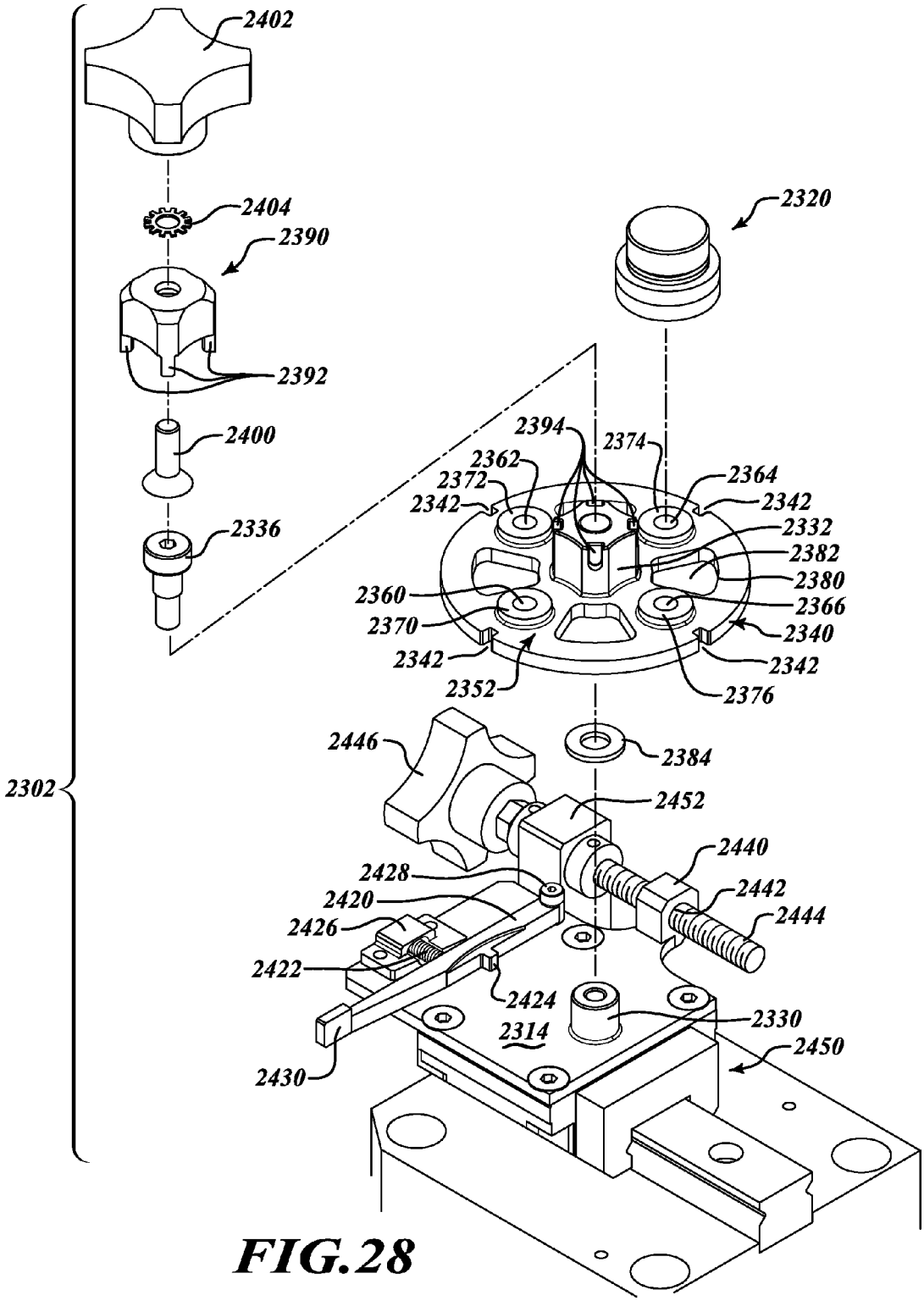
FIG. 28 is an exploded assembly view of the carousel and the rotating contouring tools of FIG. 25 in accordance with the present teachings.

With reference to FIG. 28, the tray 2134 can include a shaft 2330 on which the carousel 2304 can rotate. The carousel 2304 can include a central post 2332. The central post 2332 can define a circular inner periphery that can accept the shaft 2330. A washer 2334 can be disposed between the inner periphery of the central post 2332 on the carousel 2304 and the shaft 2330 on the tray 2314. A fastener 2336 can secure the carousel 2304 to the tray 2314 and can permit the carousel 2304 to rotate relative to the tray 2314.

The carousel 2304 can be a circular structure that can have a circular outer periphery 2340. The outer periphery 2340 can be interrupted by a multitude of grooves 2342 that can correspond with positions on the carousel 2304 on which the spinners 2320 can be located. The positions on the carousel 2304 can also correspond to apertures 2350 that can each be defined on raised protrusions 2352. The raised protrusions 2352 can extend from a top surface 2354 of the carousel 2304. Each of the apertures 2350 can accept one of the spinners 2320.

In this example, four apertures 2360, 2362, 2364, 2366 can be defined at equidistant locations from each other on the carousel 2304. The apertures 2360, 2362, 2364, 2366 can each be centered in their respective raised protrusions 2370, 2372, 2374, 2376. It will be appreciated in light of the disclosure that the apertures 2350 or the raised protrusions 2352 or both can be at various positions on the carousel 2304 and can correspond to the grooves 2342. The raised protrusions 2352 can be dispersed between portions of the structure of the carousel 2304 that can be removed to, among other things, reduce the weight of the carousel 2304. The portions of the carousel 2304 that can be removed can be referred to as web portions 2380 and can be D-shaped apertures 2382. The raised protrusions 2352 can share similar radial positions to the grooves 2342 disposed along the outer periphery 2340 of the carousel 2304. The raised protrusions 2352 can each have circular outer peripheries to accommodate inner peripheries of the spinners 2320.

The central post 2332 can extend upward and away from the tray 2314 and beyond the raised protrusions 2352. The central post 2332 can receive a cap member 2390. The cap member 2390 can have a complementary polygonal shape to the central post. In this example, the central post 2332 and the cap member 2390 can have a rectangular shape. The cap member 2390 can have a multitude of tangs 2392 that can extend downward toward the carousel 2304 and engage in corresponding notches 2394 formed on the central post 2332 of the carousel 2304. When the inner periphery of the cap member 2390 is engaged with the outer periphery of the central post 2332, the multitude of tangs 2392 on the cap member 2390 can engage into the notches 2394 formed on the central post 2332.

Figure 27:
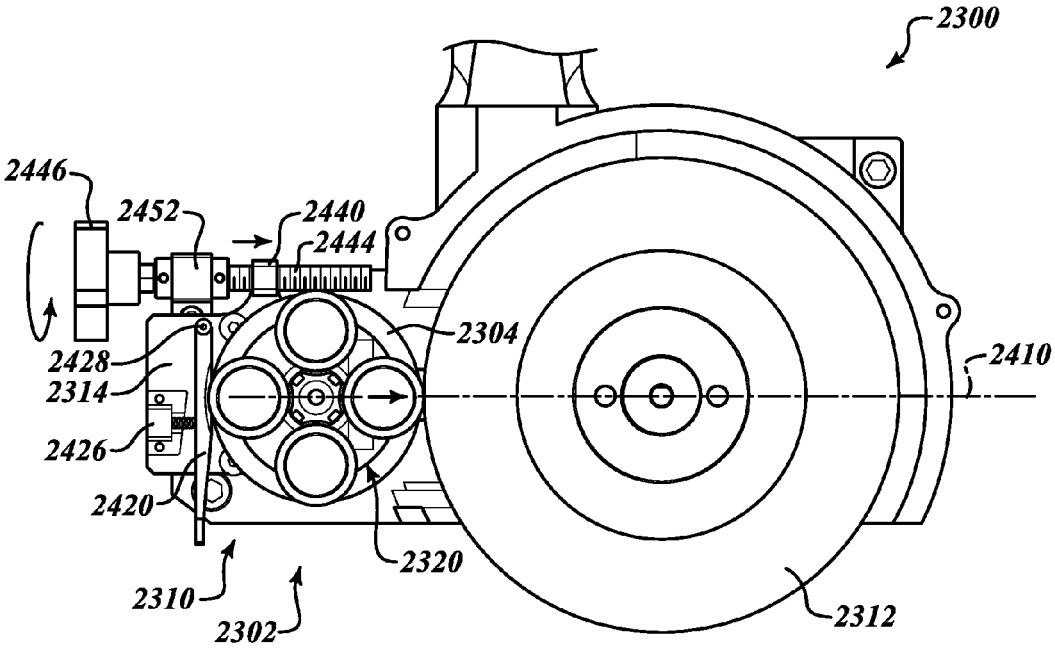
FIG. 27 is similar to FIG. 26 and shows the carousel advancing along the feed axis relative to FIG. 26 to dress the grinding wheel with the rotating contouring tool in accordance with the present teachings.

A fastener 2400 can extend through the cap member 2390 and attach to an adjusting knob 2402 that can be secured to the fastener 2400 along with a washer 2404 (e.g.: a lock washer) that can be disposed between the cap member 2390 and the adjusting knob 2402. By securing the adjusting knob 2402 to the cap member 2390, the user can impart a rotational motion on the adjusting knob 2402 and in turn, rotate the carousel 2304 on the tray 2314. By doing so, the user can rotate the carousel 2304 to a desired position that permits the carousel 2304 to align one of the spinners 2320 (i.e., one of the rotating contouring tools) in a position to translate toward the grinding wheel 2312 along a feed axis 2410 (FIG. 27). When one of the spinners 2320 can translate along the feed axis 2410 into engagement with the grinding wheel 2312, the spinner 2320 can dress the grinding wheel 2312 and impart the grinding wheel contour as the grinding wheel 2312 rotates about its axis 2412 (FIG. 25).

The user can use the adjusting knob 2402 to rotate the carousel 2304 to a desired position and a locking arm 2420 can be urged with an elastic member 2422 into engagement with the carousel 2304. Specifically, one of the grooves 2342 on the carousel 2304 can be engaged with a tang 2424 (FIG. 28) that can extend from the locking arm 2420. The elastic member 2422 that can bias the locking arm 2420 toward the carousel 2304 can be disposed between the locking arm 2420 and a base member 2426. The elastic member can be a spring. The base member 2426 can connect to the tray 2314. The locking arm 2420 can pivot about a pivot pin 2428 that can secure to the tray 2314 and can be distal from a handle portion 2430 of the locking arm 2420.

On an opposite side of the tray 2314 from where the handle portion 2430 of the locking arm 2420 extends, the tray 2314 can define a flange 2440 having an aperture 2442 formed through the flange 2440. The aperture 2442 can include a threaded interior portion. The threaded interior portion can receive a threaded fastener 2444. The threaded fastener 2444 (also referred to as a lead screw) can have an adjusting knob 2446 that can be attached to the threaded fastener 2444 at an end 2448 distal from the tray 2314. As the user rotates the adjusting knob 2446 and the threaded fastener 2444, the tray 2314 can travel and move one of the spinners 2320 into and out of engagement with the grinding wheel 2312 along the feed axis 2410. In this arrangement, the tray 2314 can be attached to a slide table 2450 that can facilitate motion in a single axis (i.e., along the feed axis 2410) into and out of engagement with the grinding wheel 2312. The slide table 2450 can not only restrict the motion of the carousel 2304 and one of the spinners 2320 along the feed axis 2410, the tray 2314 and the slide table 2450 can also contribute to the sufficient amount of mass to absorb the vibration due to the action of dressing the grinding wheel 2312.

The tray 2314 can connect to the accessory housing 2316. The accessory housing 2316 can include a flange 2452 through which the threaded fastener 2444 can rotate and cause movement of the tray 2314 on the slide table 2450 relative to the accessory housing 2316. The housing 2318 of the sharpening machine 2300 can include a dust and debris exhaust port 2454 to which various vacuum systems can connect. The exhaust port 2454 can extend from a guard member 2456 that can partially extend around the grinding wheel 2312. The housing 2318 and the accessory housing 2316 can extend from a working surface 2458 on which the user can hold the ice skate blade 2100 to be sharpened. The housing 2318, the accessory housing 2316, and the working surface 2458 can be unitary structures or can be separate components secured to one another.

A guard member 2460 can attach to the housing 2318. The guard member 2460 can remain in place and still provide access to the carousel 2304. In doing so, an access panel 2462 on the guard member 2460 can be pivoted away from the carousel 2304 to provide access. When the access panel 2462 is closed, the user can remove the cap member 2390 and adjusting knob 2402 as an assembly. The access panel 2462 can then be closed with fasteners 2464. Closing the access panel 2462 and securing the guard member to the housing 2318 or the accessory housing 2316, or both facilitates removal of grinding debris through the exhaust port 2454. With the guard member 2460 in place, the user is provided with limited but sufficient access for the grinding wheel 2312 to grind the ice skate blade 2100.

With reference to FIGS. 29-33, an exemplary blade sharpening machine 2500 can be shown with an adjustment device 2502 in accordance with a further aspect of the present teachings. The adjustment device 2502 can include a pivot arm assembly 2504 that can pivot relative to a grinding wheel 2506 that rotates about a grinding wheel axis 2508. The pivot arm assembly 2504 can include a pivot arm 2510 defining an aperture 2512 (FIG. 33) on one end 2514 distal from a shaft 2520 (FIG. 33) that extends from the pivot arm 2510 on an opposite end 2522. The shaft 2520 can rotatably support a carousel 2530 on which one or more spinners 2532 can be connected.

The aperture 2512 on the end 2514 can receive a fastener 2540 (e.g.: a shoulder bolt) that can secure the pivot arm 2510 to an accessory housing 2542 of the sharpening machine 2500. The pivot arm 2510 can swing or pivot about the fastener 2540 between a position that can engage one of the spinners 2532 on the carousel 2530 with the grinding wheel 2506 and a position that can disengage the spinners 2532 (i.e., rotating contouring tools) with the grinding wheel 2506.

Figure 30:
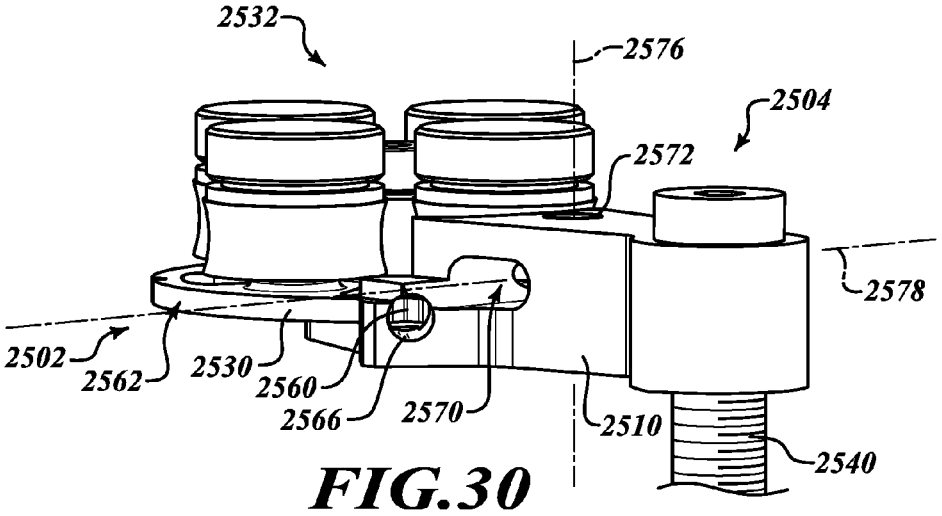
FIG. 30 is a side view of the carousel and the pivot arm of FIG. 29 in accordance with the present teachings.
Figure 31:
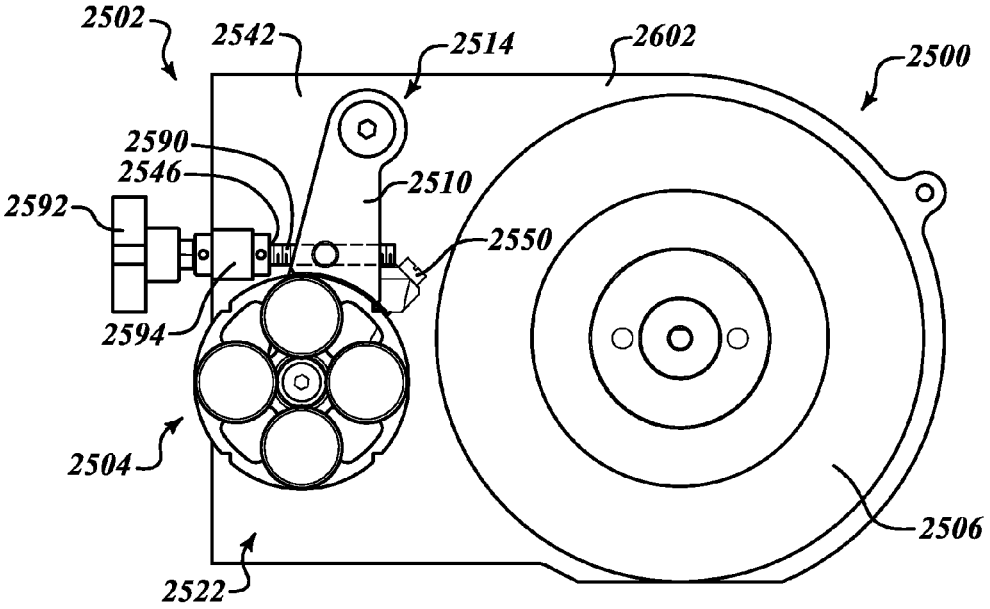
FIG. 31 is a partial top view of FIG. 29 showing a feed axis relative to the grinding wheel and the carousel with the rotating contouring tools in accordance with the present teachings.
Figure 32:
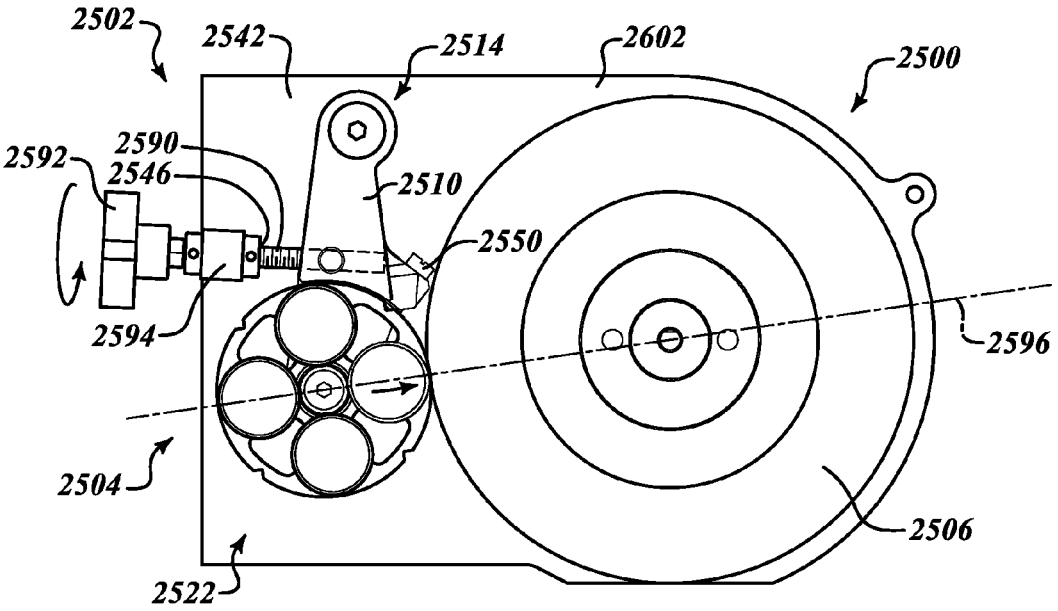
FIG. 32 is similar to FIG. 31 and shows one of the rotating contouring tools moved into engagement along the feed axis to dress the grinding wheel in accordance with the present teachings.

The pivot arm assembly 2504 can also include a locking assembly 2550 that can interact with grooves 2560 formed on an outer periphery 2562 of the carousel 2530 to hold the carousel 2530 in certain positions. With reference to FIGS. 31 and 32, the locking assembly 2550 can include a push button lock or similar device that can extend, hold, and retract a member having a protrusion 2564 (FIG. 33) into locking engagement with one of the grooves 2560 formed on the outer periphery 2562 of the carousel 2530. The locking assembly 2550 can be received in an aperture 2566 formed in the pivot arm 2510. With reference to FIG. 30, the aperture 2566 can frame a portion of the outer periphery 2562 of the carousel 2530. In certain positions of the carousel 2530, the aperture 2566 can frame one of the grooves 2560.

Figure 33:
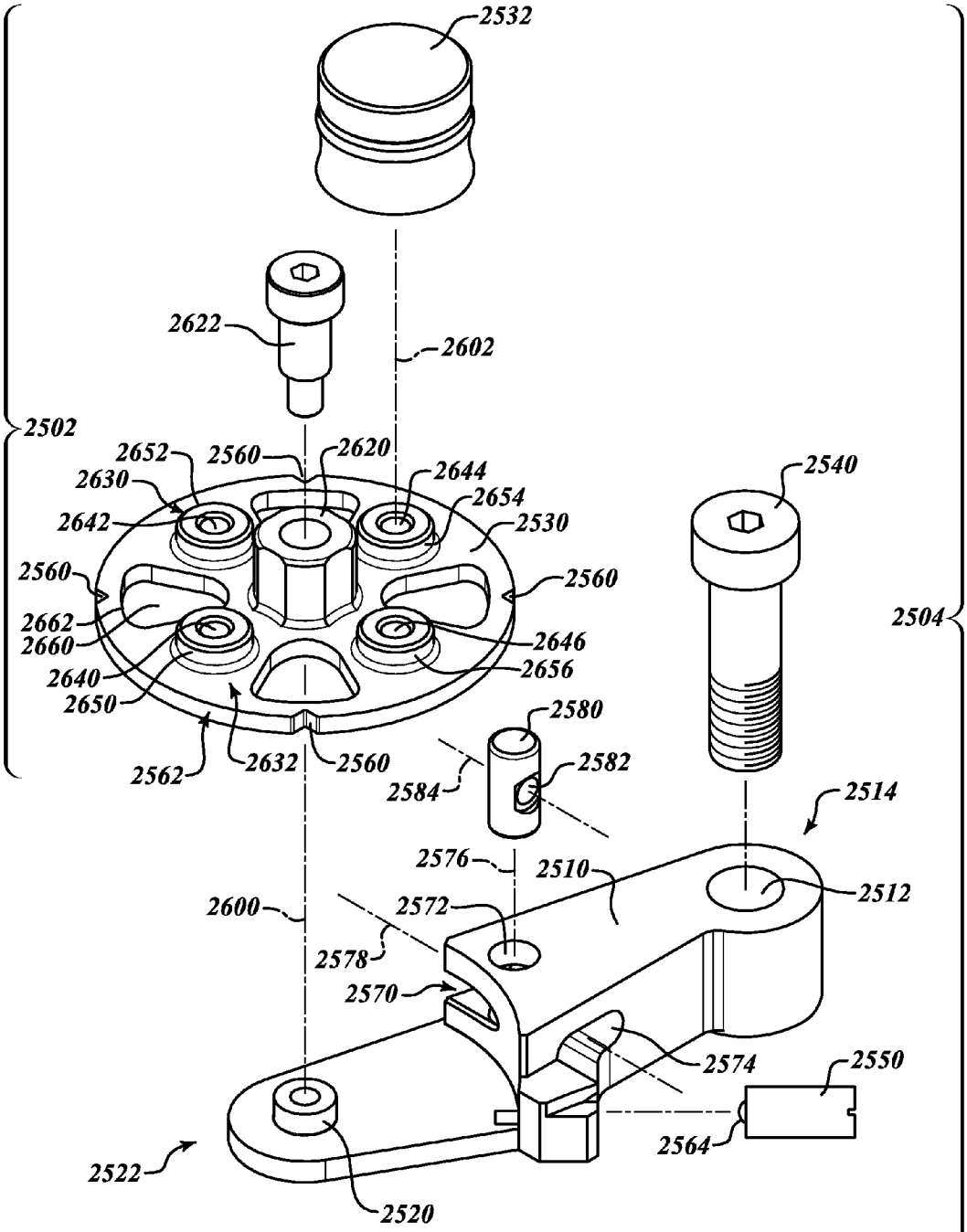
FIG. 33 is an exploded assembly view of the pivot arm assembly of FIG. 29 in accordance with the present teachings.

With reference to FIGS. 30 and 33, the pivot arm 2510 can also include an aperture 2570 formed in an area between the aperture 2512 that receives the fastener 2540 and the shaft 2520 that holds the carousel 2530. The aperture 2570 can define a first passage 2572 that can be formed through the pivot arm 2510. The first passage 2572 can be formed in the same direction of the aperture 2512 that receives the fastener 2540. The pivot arm 2510 can define a second passage 2574. The second passage 2574 can be formed through the pivot arm and can intersect the first passage 2572. The first passage 2572 can extend along axis 2576. The second passage 2574 can extend along axis 2578. The axis 2578 can be transverse to the axis 2576.

Figure 29:
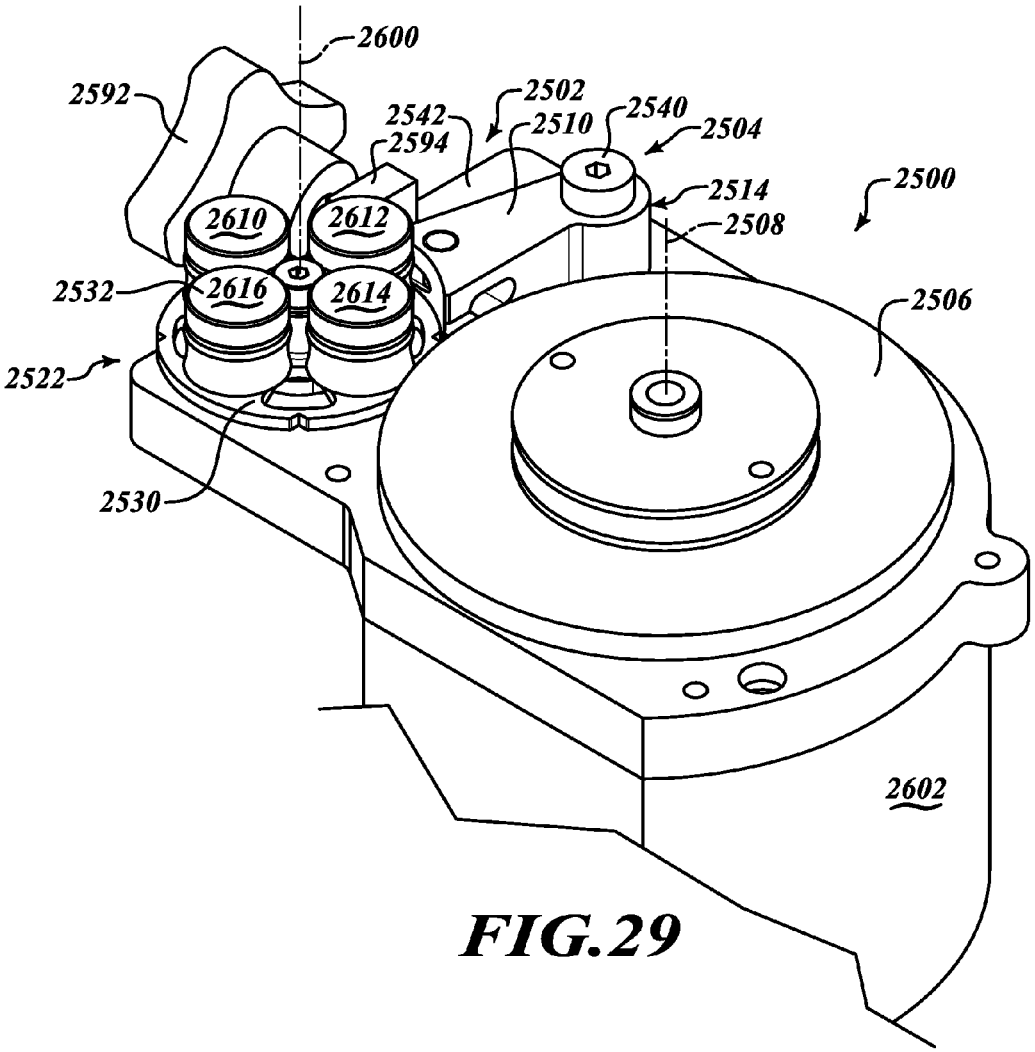
FIG. 29 is a partial isometric view showing rotating contouring tools attached to a rotatable carousel that pivots on a pivot arm of a pivot arm assembly between an engaged and a disengaged position with the grinding wheel in accordance with the present teachings.

In the aperture 2570 formed in the pivot arm 2510, the first passage 2572 can receive a pin member 2580. The pin member 2580 can include a threaded hole 2582. The threaded hole 2582 can define an axis 2584 that can be disposed parallel to the axis 2578 and transverse to the axis 2576 and the grinding wheel axis 2508 (FIG. 29). The pin 2580 can be disposed and oriented in the first passage 2572 so that the threaded hole 2582 can be aligned with the second passage 2574.

With reference to FIGS. 29, 31, and 32, a threaded fastener 2590 (also referred to as a lead screw) on the sharpening machine 2500 can be threaded into engagement with the threaded hole 2582 in the pin member 2580. By leading the threaded fastener 2590 through the second passage 2574 and engaging the pin member 2580, the threaded fastener 2590 can be threaded into engagement with the threaded knob 2582 on the pin member 2580. An adjusting knob 2592 can be connected to the lead screw or threaded fastener 2590 so the user can rotate the adjusting knob 2592 to rotate the threaded fastener 2590. A flange 2594 can extend from the accessory housing 2542 and define a threaded aperture 2596. The flange 2594 can rotatably support the threaded fastener 2590 on the accessory housing 2542 and permit movement of pivot arm 2510 relative thereto. In doing so, the threaded fastener 2590 can in effect pull and push the pin member 2580 while in the pivot arm 2510 to move the pivot arm 2510 into engagement with the grinding wheel 2506 and into a position that is disengaged from the grinding wheel 2506 along a feed axis 2596.

The carousel 2530 of the adjustment device 2502 can rotate about an axis 2600. The carousel 2530 can hold one or more of the spinners 2532 (i.e., one or more contouring tools) that can be used to dress the grinding wheel 2506. The spinners 2532 can rotate about an axis 2602. The carousel 2530 can be pivotally connected to and removable from the accessory housing 2542 (FIG. 24). The accessory housing 2542 can be coupled to or can be unitarily constructed with a housing 2602 of the blade sharpening machine 2300.

The carousel 2530 can be mounted on the pivot arm 2510 so as to be rotatable amongst a plurality of positions. For example, there can be four positions that can correspond to four of the spinners 2532 (rotating contouring tools) mounted onto the carousel 2530. With reference to FIG. 29, the spinners 2532 can include a first spinner 2610, a second spinner 2612, a third spinner 2614, and a fourth spinner 2618. A user selects one of the spinners 2532 on the carousel 2530 and the carousel 2530 can be rotated to the corresponding position and advanced toward the grinding wheel 2506 to engage and dress the grinding wheel 2506. The selected spinner, for example, can dress the grinding wheel 2506 to a grinding wheel contour associated with the first spinner 2610. The user can select another of the spinners 2532 and therefore dress the grinding wheel 2506 to another grinding wheel contour associated with the second spinner 2612 and so on.

With reference to FIG. 33, the pivot arm 2510 can include the shaft 2520 on which the carousel 2530 can rotate. The carousel 2530 can include a central post 2620. The central post 2620 can define a circular inner periphery that can accept the shaft 2520. A fastener 2622 can secure the carousel 2530 to the pivot arm 2510 and can permit the carousel 2530 to rotate relative to the pivot arm 2510 and the grinding wheel 2506.

The circular outer periphery 2562 of the carousel 2530 can be interrupted by the multitude of grooves 2560 that can correspond with the positions on the carousel 2530 on which the spinners 2532 can be located. The positions on the carousel 2530 can also correspond to apertures 2630 that can each be defined on raised protrusions 2632. The raised protrusions 2632 can extend from a top surface 2634 of the carousel 2530. Each of the apertures 2630 can accept one of the spinners 2532.

In this example, four apertures 2640, 2642, 2644, 2646 can be defined at equidistant locations from each other on the carousel 2530. The apertures 2640, 2642, 2644, 2646 can each be centered in their respective raised protrusions 2650, 2652, 2654, 2656. The raised protrusions 2632 can be dispersed between portions of the structure of the carousel 2530 that can be removed to, among other things, reduce the weight of the carousel 2530. The portions of the carousel 2530 that can be removed can be referred to as web portions 2660 and can be D-shaped apertures 2662. The raised protrusions 2632 can share similar radial positions to the grooves 2560 disposed along the outer periphery 2562 of the carousel 2530. The raised protrusions 2632 can each have circular outer peripheries to accommodate inner peripheries of the spinners 2532. It will be appreciated in light of the disclosure that the apertures 2630 or the raised protrusions 2632 or both can be at various positions on the carousel 2530 and can correspond to the grooves 2560.

The pivot arm assembly 2504 can connect to the accessory housing 2542. The accessory housing 2542 can include the flange 2594 through which the threaded fastener 2590 can rotate and cause movement of the pivot arm 2510 relative to the accessory housing 2542. The housing 2602 and the accessory housing 2542 can connect with a working surface on which the user can hold the skate blade 2100 to be sharpened. The working surface can be similar to the working surface 2458 (FIG. 25). The housing 2602, the accessory housing 2542, and the working surface 2458 can be unitary structures or can be separate components secured to one another.

The pivot arm assembly 2504 can be implemented in lieu of the carousel 2304 on the slide table 2450, when the user intends to dress a smaller diameter grinding wheel 2506 relative to the grinding wheel 2312. As such, the pivot arm assembly 2504 associated with the sharpening machine 2500 (FIG. 29) can be relatively more portable than the sharpening machine 2300 (FIG. 25). The carousel 2530 can accommodate spinners 2532 that are the same size as the spinners 2320 on the carousel 2304. In other examples, the spinners 2532 can be a smaller diameter than the spinners 2320.

Figure 34:
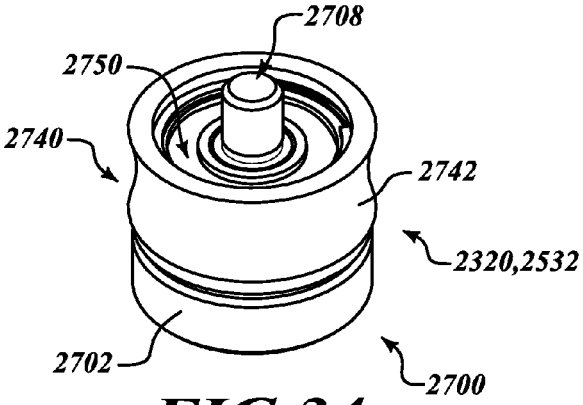
FIG. 34 is an isometric view showing a rotating contouring tool in accordance with the present teachings.
Figure 35:
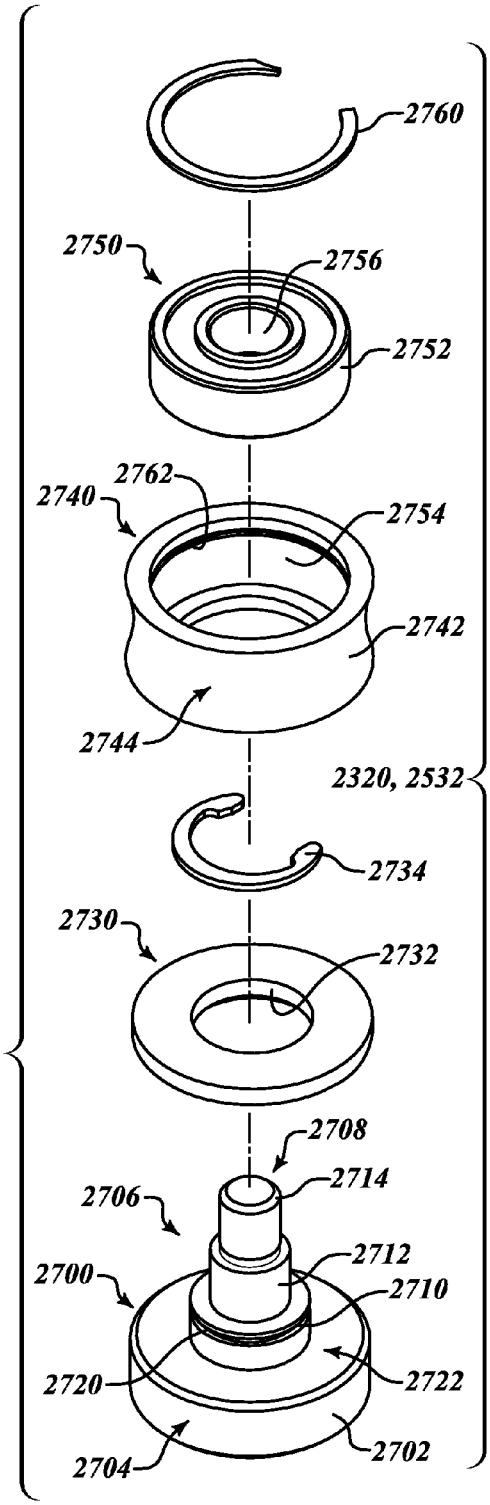
FIG. 35 is an exploded assembly view of the rotating contouring tool of FIG. 34 in accordance with the present teachings.

With reference to FIGS. 34 and 35, each of the spinners 2320, 2532 can include a fastener member 2700. The fastener member 2700 has a handle portion 2702 having an outer periphery 2706 that can be grasped by the user to secure the spinners 2320, 2532 to the carousel 2304, 2530. The fastener member 2700 can include a shaft 2706 that terminates in a connector member 2708 distal from the handle portion 2702. The shaft 2706 can have three peripheral zones 2710, 2712, 2714. The first peripheral zone 2710 can include a groove 2720 on one end of the first peripheral zone 2710 opposite an interior face 2722 of the handle portion 2702. The second peripheral zone 2712 can be disposed between the first peripheral zone 2710 and the third peripheral zone 2714. The third peripheral zone 2714 can have a diameter whose value is less than the second peripheral zone 2712 and the first peripheral zone 2710.

A washer 2730 can fit over the shaft 2706. The washer 2730 can have an inner periphery 2732 that can be seated around an outer periphery of the first peripheral zone 2710. A locking ring 2734 can secure the washer 2730 to the handle portion 2702. In some aspects of the present teachings, the locking ring 2734 can be omitted.

A ring member 2740 can include an outer periphery 2742 having a contour surface 2744. The contour surface 2744 can be configured to dress the grinding wheel 102, 2312, 2506. The contour surface 2744 can include diamond chips, carbide steel, or other examples. The contour surface 2744 can include an abrasive coating having diamond dust, chips, or grit in a plated metallic surface coating, such as electroplated nickel. The contour surface 2744 can have a profile such as a parabolic shape, an elliptical shape, or a flat-bottomed shape. Spinners 2320, 2532 can have flat-bottom shaped contour surface 2744 that can be operable to dress the grinding wheel 2312, 2506 so as to produce the profiles in FIG. 14 or FIG. 23 on the ice skate blade 2100. Other spinners can be configured to dress the grinding wheel 2312, 2506 so as to each produce one of the profiles in FIGS. 15-21 on the ice skate blade 2100.

A bearing assembly 2570 can be disposed within the ring member 2740. An outer periphery 2752 of the bearing assembly 2750 can connect with an inner periphery 2754 of the ring member 2740. An inner periphery 2756 of the bearing assembly 2750 can connect to the second peripheral zone 2712 on the shaft 2706. The bearing assembly 2750 can permit the ring member 2740 with the contour surface 2742 to rotate relative to the handle portion 2702.

A retaining clip 2760 can be secured within a groove 2762 formed in the inner periphery 2754 of the ring member 2740 to secure the bearing assembly 2750 within the ring member 2740. The inner periphery 2756 of the bearing assembly 2750 can be press-fit onto the shaft 2706 so as to be releasably secured to the second peripheral zone 2712. The connector member 2708 of the spinners 2320, 2532 can be received by the apertures 2350, 2360 on the carousel 2304, 2530.

The foregoing description of the aspects of the present teachings has been provided for purposes of illustration and description. It is not intended to be exhaustive or to limit the disclosure. Individual elements or features of a particular aspect are generally not limited to that particular aspect, but, where applicable, are interchangeable and can be used in a selected aspect, even if not specifically shown or described. The same may also be varied in many ways. Such variations are not to be regarded as a departure from the disclosure, and all such modifications are intended to be included within the scope of the disclosure. In some example aspects, well-known processes, well-known device structures, and well-known technologies are not described in detail.

The terminology used herein is for the purpose of describing particular example aspects of the present teachings only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer, or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the exemplary aspects of the present teachings.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A method of sharpening a single ice skate blade having a length adapted to be attached to an ice skate and an ice engaging surface adapted to contact ice, comprising:

engaging a contouring tool with a grinding wheel to form a grinding wheel contour on a periphery of the grinding wheel; and engaging the grinding wheel contour with the ice skate blade to form a contoured ice skate blade, the contoured ice skate blade having:

(i) a single profile extending along at least a portion of the length, the profile having a width between a first side edge and a second side edge, wherein at least one of the side edges ends at a bottom end at the ice engaging surface, (ii) a vee defined by one of the side edges and a flat meeting at the bottom end, wherein a first acute edge angle is formed between the one of the side edges and the flat, and (iii) a flat angle formed between the flat and a bottom, wherein the bottom has a bottom distance which extends from the flat to one of a second flat and a second one of the side edges.

2. The method of claim 1, wherein the length comprises a rocker radius and at least one entry radius, and the profile extends along the rocker radius.

3. The method of claim 2, wherein the profile extends along the entry radius.

4. The method of claim 1, wherein both of the edges end at the bottom end at the ice engaging surface.

5. The method of claim 4, wherein the contoured ice skate blade further includes a second vee defined by the other of the side edges and the second flat meeting at the bottom end, wherein a second acute edge angle is formed between the other of the side edges and the second flat.

6. The method of claim 5, wherein the contoured ice skate blade further includes relief pockets positioned between the bottom and each of the flats.

7. The method of claim 5, wherein the second acute edge angle is different than the first acute edge angle.

8. The method of claim 1, wherein the contoured ice skate blade further includes a relief pocket positioned between the bottom and the flat.

9. The method of claim 1, wherein the bottom is linear in cross section across the width, and a height is defined by a distance between a point formed by a line extending collinearly from the bottom to one of the side edges and the bottom end of the same side edge.

10. The method of claim 9, wherein the width is 0.110 inches and the bottom distance ranges from 0.080 to 0.105 inches and the height is 0.001 to 0.0005 inches.

11. The method of claim 1, wherein the contoured ice skate blade further includes a centerline defined as the midpoint between the side edges along the width, and the bottom is symmetrical about the centerline.

12. The method of claim 1, wherein the bottom and the flat combine to form an elliptical bottom having the shape of an ellipse with a pair of non-identical focal points.

13. A method of contouring a single ice skate blade, comprising:

engaging a contouring tool with a grinding wheel to form a grinding wheel contour on a periphery of the grinding wheel; and engaging the grinding wheel contour with the ice skate blade to form a contoured ice skate blade, the contoured ice skate blade having:

(i) a first side wall and a second side wall opposite the first side wall, (ii) a flat bottom disposed between the first side wall and the second side wall, (iii) a first flat formed between the flat bottom and the first side wall, the first flat forming a first flat angle with the flat bottom, (iv) a second flat formed between the flat bottom and the second side wall, the second flat forming a second flat angle with the flat bottom, the second flat angle being about equal to the first flat angle, (v) a first bottom edge formed at a junction of the first side wall and the first flat, (vi) a second bottom edge formed at a junction of the second side wall and the second flat, (vii) a first vee formed from the first side edge, the first bottom edge, and the first flat, the first vee defining a first edge angle between the first flat and the first side edge, and (viii) a second vee formed from the second side edge, the second bottom edge, and the second flat, the second vee defining a second edge angle between the second flat and the second side edge, the second edge angle being about equal to the first edge angle, wherein the flat bottom, the first side wall, the second side wall, the first vee, and the second vee are a unitary structure.

14. The method of claim 13, wherein (i) the first flat contacts the flat bottom, (ii) the second flat contacts the flat bottom, and (iii) a first distance defined between a center line and where the first flat contacts the flat bottom and a second distance between where the second flat contacts the flat bottom and the center line are about equal.

15. The method of claim 13, wherein the first side wall, the second side wall, the first vee, the second vee, and the flat bottom are formed from a single piece of metal.

16. A method of sharpening a single ice skate blade having a length adapted to be attached to an ice skate and an ice engaging surface adapted to contact ice, comprising:

engaging a contouring tool with a grinding wheel to form a grinding wheel contour on a periphery of the grinding wheel; and engaging the grinding wheel contour with the ice skate blade to form a contoured ice skate blade, the contoured ice skate blade having:

a first side wall and a second side wall opposite the first side wall, a flat bottom disposed between the first side wall and the second side wall, a first flat formed between the flat bottom and the first side wall, the first flat forming a first flat angle with the flat bottom, a second flat formed between the flat bottom and the second side wall, the second flat formed adjacent the flat bottom on an opposite side of a center line from the first flat, the second flat forming a second flat angle with the flat bottom, a first bottom edge formed at a junction of the first side wall and the first flat, a second bottom edge formed at a junction of the second side wall and the second flat, a first vee formed from the first side edge, the first bottom edge, and the first flat, the first vee defining a first edge angle between the first flat and the first side edge, and a second vee formed from the second side edge, the second bottom edge, and the second flat, the second vee defining a second edge angle between the second flat and the second side edge, wherein a first line that extends parallel to the first flat intersects with a second line that extends parallel to the second flat, the first line intersecting the second line at the center line.

17. The method of claim 16, wherein the first side wall, the second side wall, the first vee, the second vee, and the flat bottom are formed from a single piece of metal.

18. A method of sharpening a single ice skate blade having a length adapted to be attached to an ice skate and an ice engaging surface adapted to contact ice, comprising:

engaging a contouring tool with a grinding wheel to form a grinding wheel contour on a periphery of the grinding wheel; and engaging the grinding wheel contour with the ice skate blade to form a contoured ice skate blade, the contoured ice skate blade having:

a first side wall and a second side wall opposite the first side wall;

a flat bottom disposed between the first side wall and the second side wall;

a first flat formed between the flat bottom and the first side wall, the first flat forming a first flat angle with the flat bottom;

a second flat formed between the flat bottom and the second side wall, the second flat formed adjacent the flat bottom on an opposite side of a center line from the first flat, the second flat forming a second flat angle with the flat bottom;

a first bottom edge formed at a junction of the first side wall and the first flat;

a second bottom edge formed at a junction of the second side wall and the second flat;

a first vee formed from the first side wall, the first bottom edge, and the first flat, the first vee defines a first edge angle between the first flat and the first side wall; and a second vee formed from the second side wall, the second bottom edge, and the second flat, the second vee defines a second edge angle between the second flat and the second side wall, wherein a first line that extends parallel to the first flat intersects with a second line that extends parallel to the second flat, the first line intersects the second line at an intersection that is spaced from the center line.

19. The method of claim 18, wherein (i) the first flat contacts the flat bottom, (ii) the second flat contacts the flat bottom, and (iii) a first distance defined between the center line and where the first flat contacts the flat bottom and a second distance between where the second flat contacts the flat bottom and the center line are about equal.

20. The method of claim 18, wherein the first side wall, the second side wall, the first vee, the second vee, and the flat bottom are formed from a single piece of metal.

* * * * *